US007333063B2

(12) United States Patent
Yano et al.

(10) Patent No.: US 7,333,063 B2
(45) **Date of Patent: *Feb. 19, 2008**

(54) ELECTRONIC DEVICE AND ANTENNA APPARATUS

(75) Inventors: Junro Yano, Hamura (JP); Soh Kimura, Kodaira (JP); Makoto Sawada, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/516,918

(22) Filed: Sep. 7, 2006

(65) Prior Publication Data

US 2007/0001917 A1 Jan. 4, 2007

Related U.S. Application Data

(63) Continuation of application No. 11/002,348, filed on Dec. 1, 2004, now Pat. No. 7,126,548.

(30) Foreign Application Priority Data

Dec. 2, 2003 (JP) ..... 2003-402675
Apr. 21, 2004 (JP) ..... 2004-125922

(51) Int. Cl.
*H01Q 1/22* (2006.01)
*H01Q 7/00* (2006.01)
*G04B 47/00* (2006.01)

(52) U.S. Cl. ..... 343/702; 343/718; 343/788; 368/10

(58) Field of Classification Search ..... 343/702, 343/718, 788; 455/575.7; 368/10
See application file for complete search history.

(56) References Cited

U.S. PATENT DOCUMENTS

| | | | |
|---|---|---|---|
| 5,541,610 | A | 7/1996 | Imanishi et al. |
| 6,657,922 | B2 | 12/2003 | Sato |
| 6,825,751 | B1 | 11/2004 | Kita et al. |
| 2003/0179151 | A1 | 9/2003 | Senba |
| 2003/0231020 | A1 | 12/2003 | Yonezawa et al. |
| 2005/0162331 | A1 | 7/2005 | Endo et al. |

FOREIGN PATENT DOCUMENTS

| | | | |
|---|---|---|---|
| EP | 1288016 | A1 | 3/2003 |
| JP | 59-14086 | U | 1/1984 |
| JP | 07-191157 | A | 7/1995 |
| JP | 08-016745 | A | 1/1996 |
| JP | 2000-082891 | A | 3/2000 |
| JP | 2000-286761 | A | 10/2000 |
| JP | 2001-033571 | A | 2/2001 |
| JP | 2002-158484 | A | 5/2002 |
| JP | 2003-035787 | A | 2/2003 |
| WO | WO 03/061069 | A1 | 7/2003 |

*Primary Examiner*—Michael C. Wimer
(74) *Attorney, Agent, or Firm*—Frishauf, Holtz, Goodman & Chick, P.C.

(57) ABSTRACT

In an electronic device having a metal device case, and an antenna disposed inside the device case, a magnetic member having a magnetic permeability higher than a magnetic permeability of the device case is placed between an inner surface of the device case and the antenna.

23 Claims, 33 Drawing Sheets

| MEASURING CONDITION | MEASURING RESULT | | | | | | | |
|---|---|---|---|---|---|---|---|---|
| MAGNETIC PERMEABILITY μ | 40kHz | | | | 60kHz | | | |
| | L [mH] | Q | Z [kΩ] | SENSITIVITY [dB] | L [mH] | Q | Z [kΩ] | SENSITIVITY [dB] |
| (NONE) | 17.62 | 18 | 78 | 48 | 17.70 | 15 | 99 | 47 |
| 1.4 | 17.70 | 16 | 73 | 48 | 17.78 | 15 | 97 | 47 |
| 4.5 | 17.97 | 17 | 78 | 46 | 18.07 | 15 | 101 | 46 |
| 60 | 19.68 | 24 | 118 | 46 | 19.96 | 21 | 156 | 45 |
| 500 | 20.61 | 27 | 138 | 46 | 20.97 | 25 | 194 | 46 |
| 8000 | 20.98 | 29 | 151 | 46 | 21.39 | 26 | 210 | 46 |

Fig. 34A

| OUTPUT ELECTRIC WAVE | RECEPTION SENSITIVITY [dB μV/m] |
|---|---|
| JYY40 | 51 |
| JYY60 | 50 |

Fig. 34B

| OUTPUT ELECTRIC WAVE | RECEPTION SENSITIVITY [dB μV/m] |
|---|---|
| JYY40 | 48 |
| JYY60 | 48 |

ELECTRONIC DEVICE AND ANTENNA APPARATUS

CROSS-REFERENCE TO RELATED APPLICATION

This is a Continuation Application of U.S. patent application Ser. No. 11/002,348 filed Dec. 1, 2004, now U.S. Pat. No. 7,126,548 the entire contents of which is incorporated herein by reference.

BACKGROUND OF THE INVENTION

1. Field of the Invention

The present invention relates to an electronic device and an antenna apparatus, which are equipped with an antenna that receives predetermined electric waves.

2. Description of the Related Art

There is a radio wave watch which is one type of electronic devices. The watch has a bar antenna which receives a standard radio wave including timing data (i.e., time code) and corrects the time based on the standard radio wave received at the bar antenna.

The bar antenna faces a problem such that when a magnetic member is present nearby, the magnetic flux which is generated in the antenna coil passes the nearby metal, generating an eddy current, which degrades the reception sensitivity of the antenna.

As a solution to the problem, a wristwatch case is formed of a synthetic resin, a recess open upward is formed in the band attachment portion on the 12 o'clock side, and a bar antenna is retained in the recess to separate the bar antenna from a metal back cover as disclosed in U.S. Pat. No. 6,657,922.

The wristwatch case of a resin is inferior in texture and weightiness to a metal wristwatch case, and does not look high-grade.

SUMMARY OF THE INVENTION

Accordingly, it is an object of the invention to provide an electronic device and an antenna apparatus, which do not degrade the reception performance of the antenna even when an armoring component, such as a device case or a back cover, is partly or entirely formed of a metal.

To achieve the object, an electronic device according to the invention has a metal device case; an antenna disposed inside the device case; and a magnetic member placed between an inner surface of the device case and the antenna, and having a magnetic permeability higher than a magnetic permeability of the device case.

The invention can provide an electronic device and an antenna apparatus, which do not degrade the reception sensitivity of the antenna even when an armoring component, such as a case or a back cover, is partly or entirely formed of a metal.

BRIEF DESCRIPTION OF THE DRAWINGS

FIG. 34A is a diagram showing measurements of the reception efficiency of an antenna with a stainless ring, and FIG. 34B is a diagram showing measurements of the reception efficiency of the antenna without a stainless ring.

DETAILED DESCRIPTION OF THE PREFERRED EMBODIMENT

First Embodiment

Figure 1:
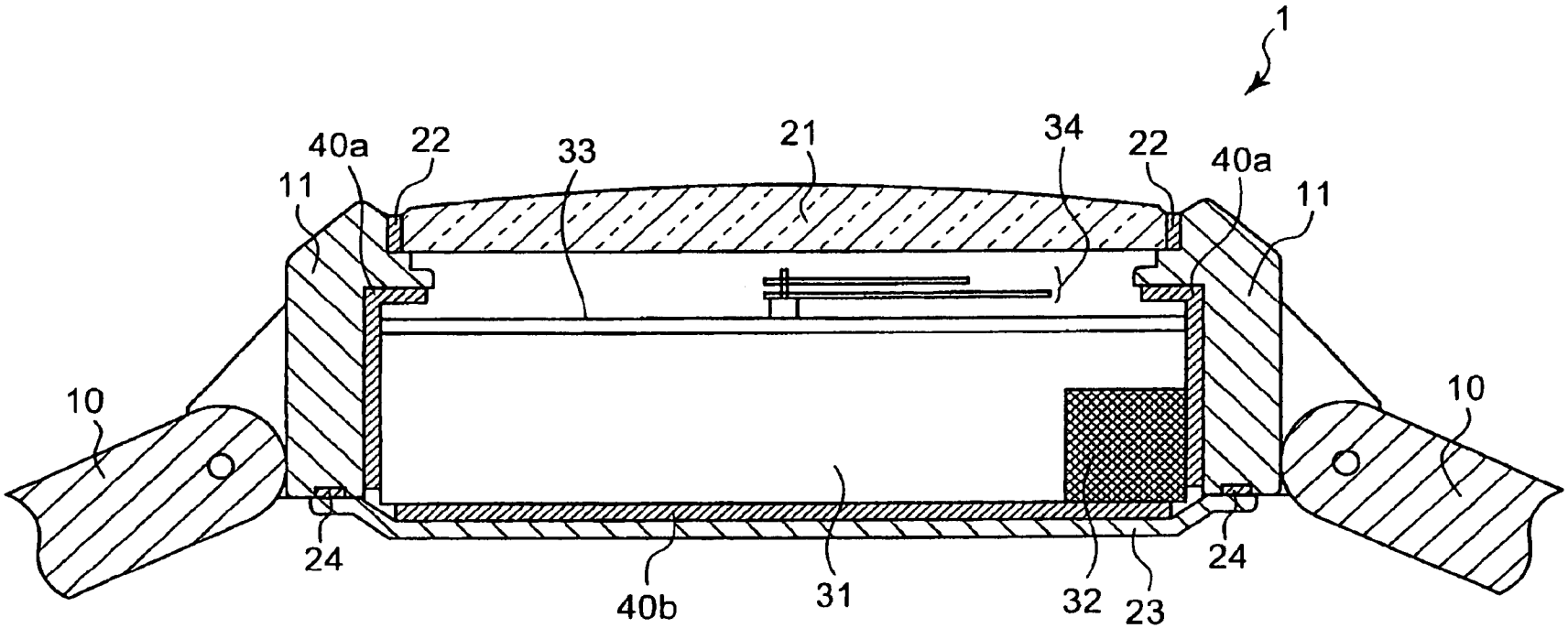
FIG. 1 is a schematic cross-sectional view of a wristwatch according to a first embodiment of the invention.

FIG. 1 is a schematic cross-sectional view of a wristwatch 1 according to the first embodiment. The wristwatch 1 has a watch case 11 as an armoring component and a back cover 23 as an armoring component. The watch case 11 and the back cover 23 constitute the casing of an electronic device. A watch module 31 is housed in the watch case 11 of the wristwatch 1, and an antenna 32 which receives standard radio waves is retained in the watch module 31. Bands 10, 10 for mounting an electronic device to an arm are attached to the wristwatch 1 in the directions of 12 o'clock and 6 o'clock of the watch case 11.

The antenna 32 is a bar antenna, and includes a rod-shaped core formed of a magnetic material, such as amorphous magnetic or ferrite, which has a high specific magnetic permeability with and a low electric conductivity, and a coil obtained by winding a conductive wire of copper or so around the core. When the antenna 32 is placed in a magnetic field generated by the standard radio wave (hereinafter called "signal field"), a magnetic flux caused by the signal field (hereinafter called "signal flux") is concentrated on the core whose specific magnetic permeability is higher than that of the ambient space, and crosses the coil in a chain fashion, generating an induced electromotive force in such a way as to generate a demagnetization flux in the coil in the direction of preventing a change in signal flux in the coil. As the standard radio wave is an AC signal, the induced electromotive force generated is alternate force.

The watch module 31 further has an IC chip having various kinds of circuits, and an analog hand mechanism for moving hands 34, such as an hour hand and a second hand, on a face 33. The circuit elements of the IC chip includes a control IC, such as a CPU, which controls the individual sections of the watch module 31, a reception circuit which is electrically connected to the coil of the antenna 32 by a lead wire of copper or so to detect the induced electromotive force, generated in the coil of the antenna 32, amplify and demodulate the detected electric signal, and acquire time data (i.e., time code) included in the standard radio wave, and a timing circuit having an oscillator to measure the current time. The control IC performs processes, such as correcting the time measured by the timing circuit based on the time data acquired by the reception circuit, and controlling the analog hand mechanism to move the hands 34 to show the corrected current time.

The watch case 11 is formed of a metal, such as stainless steel or titanium, and has an annular shape. A watch glass 21 is fitted in the center portion of the top surface of the watch case 11 via a packing 22 in such a way that the face 33 inside the watch case 11 is visible. A back cover 23 formed of a metal similar to the metal of the watch case 11 is attached to the bottom surface of the watch case 11 via a water-proof ring 24. Those components constitute a casing.

In the watch case 11, the watch module 31 is placed above the back cover 23, and the face 33 is laid above the watch module 31. The antenna 32 is retained in the watch module 31 on the 12 o'clock side.

Magnetic sheets 40*a* and 40*b* are adhered to the inner surface of the watch case 11 and the inner surface of the back cover 23 (the surface which faces the watch case 11; the top surface in the diagram), respectively. Each of the magnetic sheets 40*a* and 40*b* is formed by compounding a magnetic material, such as amorphous magnetic or ferrite, into a resin sheet and is a magnetic member having a specific magnetic permeability higher than those of the metals forming the watch case 11 and the back cover 23 and an electric conductivity lower than those of the metals. That is, the wristwatch 1 has the magnetic sheets 40*a* and 40*b* or magnetic members disposed between the antenna 32 and the metal watch case 11 and the metal back cover 23.

The demagnetization field (flux) generated in the antenna 32 with respect to the signal field is distributed in such a way as to take a path with a lower magnetic resistance. Specifically, the specific magnetic permeability of the magnetic sheet 40*a* is higher than that of the metal watch case 11. Of the magnetic flux generated in the antenna 32, therefore, the magnetic flux at the portion facing the inner surface of the watch case 11 passes through the magnetic sheet 40*a* having a lower magnetic resistance, so that a very few flux passes through the watch case 11. The specific magnetic permeability of the magnetic sheet 40*b* is higher than that of the metal back cover 23. Of the magnetic flux generated in the antenna 32, therefore, the magnetic flux at the portion facing the inner surface of the back cover 23 passes through the magnetic sheet 40*b* having a lower magnetic resistance, so that a very few flux passes through the back cover 23.

In other words, as there is a very few magnetic flux that passes through the watch case 11 and the back cover 23, the eddy current is hardly generated. Because the magnetic sheets 40*a* and 40*b* have low electric conductivities, the eddy current is hardly generated even when the magnetic flux passes through the magnetic sheets 40*a* and 40*b*. Therefore, the eddy current loss by the demagnetization field generated in the antenna 32 hardly occurs, thereby suppressing the degradation (reduction) of the reception sensitivity of the antenna 32 which is caused by the installation (arrangement) of the antenna 32 inside the metal watch case 11.

Operation and Effect

As the wristwatch 1 according to the first embodiment has the magnetic sheets 40*a* and 40*b* or magnetic members disposed between the watch case 11 and the back cover 23 both formed of metals, and the antenna 32, the eddy current loss originating from the magnetic flux passing through a metal hardly occurs, so that the degradation (reduction) of the reception sensitivity of the antenna 32 is suppressed.

The watch case 11 in FIG. 1 may be formed of a synthetic resin, such as an ABS resin, instead of a metal. In this case, the magnetic sheet 40*b* adhered to the inner surface of the watch case 11 becomes unnecessary, and the magnetic sheet 40*a* adhered to the inner surface of the back cover 23 alone is needed. This is because no eddy current flows in the synthetic resin forming the watch case 11, i.e., the eddy current loss does not occur, even if the magnetic flux passes through the watch case 11, so that the reception sensitivity of the antenna 32 is not degraded.

Second Embodiment

The second embodiment will be described below.

To avoid the redundant description, like or same reference numerals are given to those components of the second embodiment which are the same as the corresponding components of the first embodiment.

Figure 2:
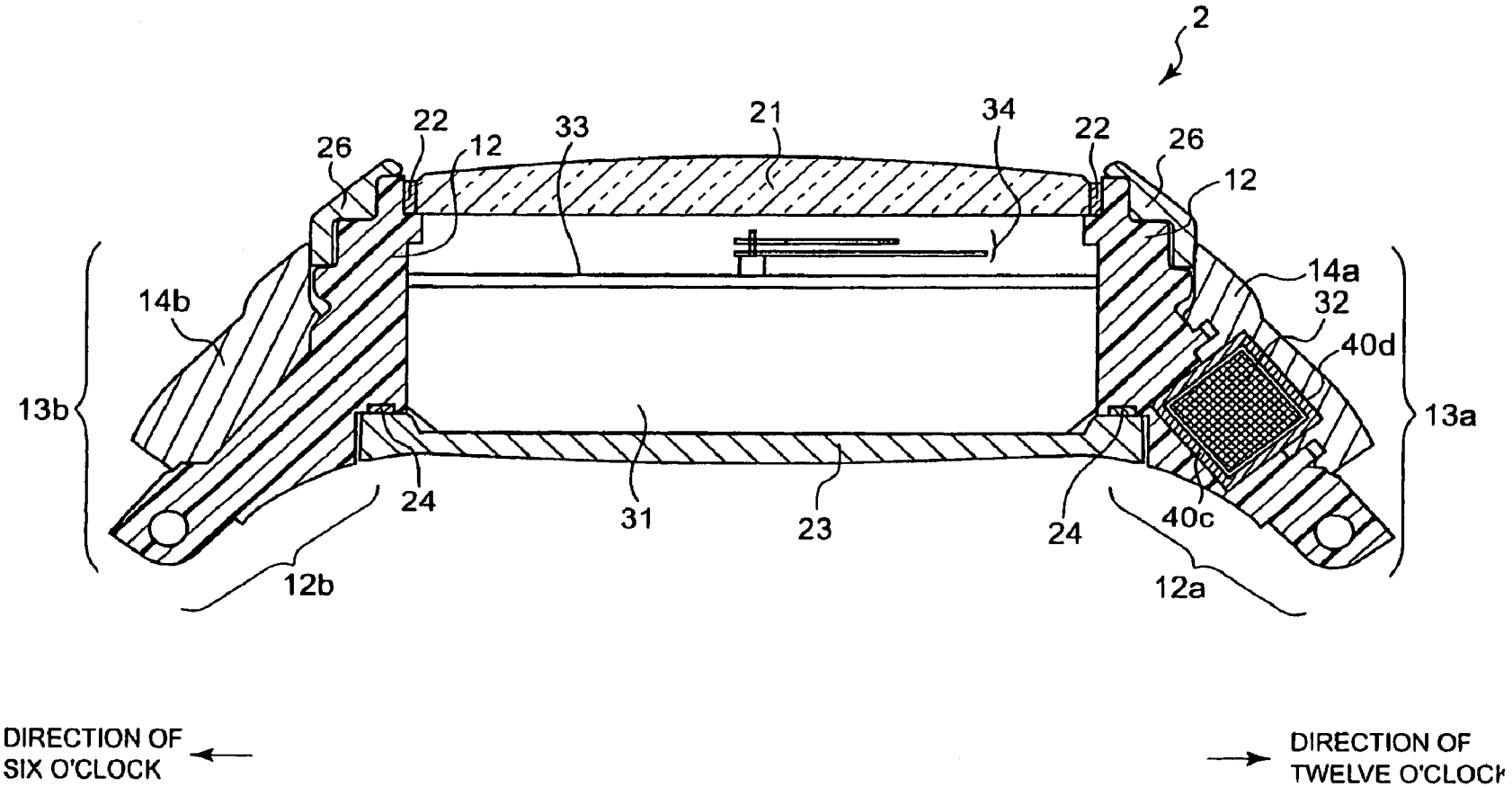
FIG. 2 is a schematic cross-sectional view of a wristwatch according to a second embodiment of the invention.

FIG. 2 is a schematic cross-sectional view of a wristwatch 2 according to the second embodiment. In the diagram, the right-hand side is the direction of 12 o'clock, and the left-hand side is the direction of 6 o'clock. Referring to FIG. 2, the wristwatch 2 has a watch case 12 and a back cover 23 which constitute a casing. The wristwatch 2 is a radio wave watch having an antenna 32 and a watch module 31.

The watch case 12 is formed of a synthetic resin, such as an ABS resin, and has an annular shape. A watch glass 21 is fitted in the watch case 12 via a packing 22 with a metal bezel 26 attached to the peripheral portion of the top surface of the watch case 12. The watch case 12 is provided with extending portions 13*a* and 13*b* extending outward, at two side portions corresponding to the positions of 12 o'clock and 6 o'clock. The extending portions 13*a* and 13*b* are respectively comprised of extending portions 12*a* and 12*b* and cover members 14*a* and 14*b* as armoring components attached to the top surfaces of the associated extending portions 12*a* and 12*b*. The cover members 14*a* and 14*b* are formed of metals.

Particularly, a recess open upward is formed in the extending portion 12*a* formed at the position of 12 o'clock, and the antenna 32 is retained in the recess. A recess open downward is formed in the bottom side of the cover member 14*a*, attached to the top surface of the extending portion 12*a* (the side facing the extending portion 12*a*; the bottom surface in the diagram), to cover the antenna 32. The extending portion 12*a* of the watch case 12 is provided with a communication passage (not shown) for lead wires to connect the coil of the antenna 32 to the watch module 31.

Magnetic sheets 40*c* and 40*d* are respectively adhered to the surface portions facing the antenna 32, i.e., the inner surface of the recess formed in the extending portion 12*a* and the inner surface of the recess formed in the cover member 14*a*. That is, the wristwatch 2 has the magnetic sheets 40*c* and 40*d* or magnetic members disposed between the antenna 32 and the metal back cover 23 and the cover member 14*a*.

The demagnetization field (flux) generated in the antenna 32 with respect to the signal field is distributed in such a way as to take a path with a lower magnetic resistance. Specifically, the specific magnetic permeability of the magnetic sheet 40*c* is higher than that of the metal back cover 23. Of the magnetic flux generated in the antenna 32, therefore, the magnetic flux at the portion close to the inner surface of the back cover 23 passes through the magnetic sheet 40*c* having a lower magnetic resistance, so that a very few flux passes through the back cover 23. The specific magnetic permeability of the magnetic sheet 40*d* is higher than that of the cover member 14*a* formed of a metal. Of the magnetic flux generated in the antenna 32, therefore, the magnetic flux at the portion facing the inner surface of the recess of the cover member 14*a* passes through the magnetic sheet 40*d* having a lower magnetic resistance, so that a very few flux passes through the cover member 14*a*.

In other words, as there is a very few magnetic flux that passes through the back cover 23 and the cover member 14*a*, the eddy current is hardly generated. Because the magnetic sheets 40*c* and 40*d* have low electric conductivities, the eddy current is hardly generated even when the magnetic flux passes through the magnetic sheets 40*c* and 40*d*. Therefore, the eddy current loss by the demagnetization field generated in the antenna 32 hardly occurs, thereby suppressing the degradation (reduction) of the reception sensitivity of the antenna 32 which is originated from the formation of the cover member 14*a* of a metal.

Operation and Effect

As the wristwatch 2 according to the second embodiment has the magnetic sheets 40*c* and 40*d* or magnetic members disposed between the back cover 23 and the cover member 14*a* both formed of metals, and the antenna 32, the eddy current loss originating from the magnetic flux passing through a metal hardly occurs. This suppresses the degradation (reduction) of the reception sensitivity of the antenna 32.

Third Embodiment

The third embodiment will be described below.

To avoid the redundant description, like or same reference numerals are given to those components of the third embodiment which are the same as the corresponding components of the first and second embodiments.

Figure 3:
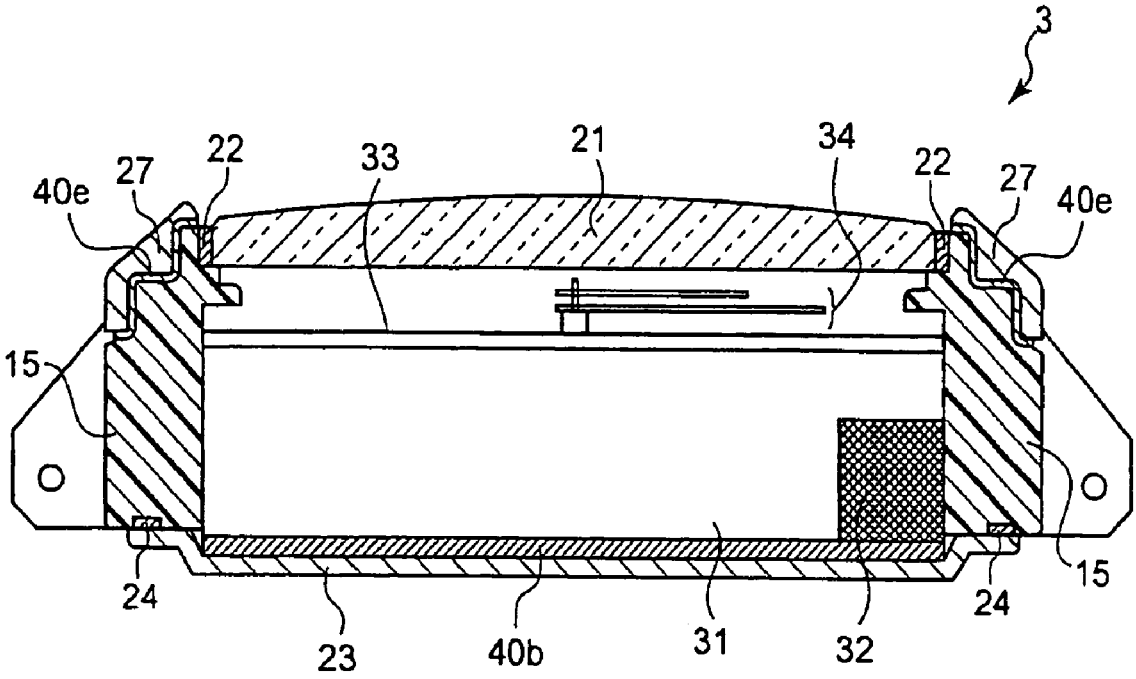
FIG. 3 is a schematic cross-sectional view of a wristwatch according to a third embodiment of the invention.

FIG. 3 is a schematic cross-sectional view of a wristwatch 3 according to the second embodiment. In the diagram, the wristwatch 3 has armoring components, such as a watch case 15, a back cover 23 and a bezel 27, which constitute a casing. The wristwatch 3 is a radio wave watch equipped with a watch module 31 having an antenna 32.

The watch case 15 is formed of a synthetic resin, and a bezel 27 of a metal is attached to the peripheral portion of the top surface of the watch case 15 to decorate the outer surface thereof. In the watch case 15, the antenna 32 is arranged above the back cover 23 and a face 33 is arranged further above.

Magnetic sheets 40*b* and 40*e* are respectively adhered to the inner surface of the back cover 23 (the inner side of the watch case 15; the top surface in the diagram) and the bottom surface of the bezel 27 (that side which faces the watch case 15; the bottom surface in the diagram). That is, the wristwatch 3 has the magnetic sheets 40*b* and 40*e* or magnetic members disposed between the antenna 32 and the metal back cover 23 and the metal bezel 27.

The demagnetization field (flux) generated in the antenna 32 with respect to the signal field is distributed in such a way as to take a path with a lower magnetic resistance. Specifically, the specific magnetic permeability of the magnetic sheet 40*b* is higher than that of the metal back cover 23. Of the magnetic flux generated in the antenna 32, therefore, the magnetic flux at the portion facing the inner surface of the back cover 23 passes through the magnetic sheet 40*b* having a lower magnetic resistance, so that a very few flux passes through the back cover 23. The specific magnetic permeability of the magnetic sheet 40*e* is higher than that of the bezel 27 formed of a metal. Of the magnetic flux generated in the antenna 32, therefore, the magnetic flux at the portion close to the bottom surface of the bezel 27 passes through the magnetic sheet 40*e* having a lower magnetic resistance, so that a very few flux passes through the bezel 27.

In other words, as there is a very few magnetic flux that passes through the back cover 23 and the bezel 27, the eddy current is hardly generated. Because the magnetic sheets 40*b* and 40*e* have low electric conductivities, the eddy current is hardly generated even when the magnetic flux is generated. As the eddy current loss by the demagnetization field generated in the antenna 32 hardly occurs, therefore, the degradation (reduction) of the reception sensitivity of the antenna 32 is suppressed.

Operation and Effect

As the wristwatch 3 according to the third embodiment has the magnetic sheets 40*b* and 40*e* or magnetic members disposed between the back cover 23 and the bezel 27 both formed of metals, and the antenna 32, the eddy current loss originating from the magnetic flux passing through a metal hardly occurs. This suppresses the degradation (reduction) of the reception sensitivity of the antenna 32.

Modifications of First, Second and Third Embodiments (1) Layout Positions and Sizes of Magnetic Sheets Although the magnetic sheets 40*a* and 40*b* are adhered to the entire inner surface of the watch case 11 and the entire inner surface of the back cover 23 in the first embodiment (see FIG. 1), for example, the magnetic sheets may be adhered partially. Specifically, the magnetic sheets are adhered near the antenna 32, as shown in FIGS. 4A and 4B.

Figure 4A:
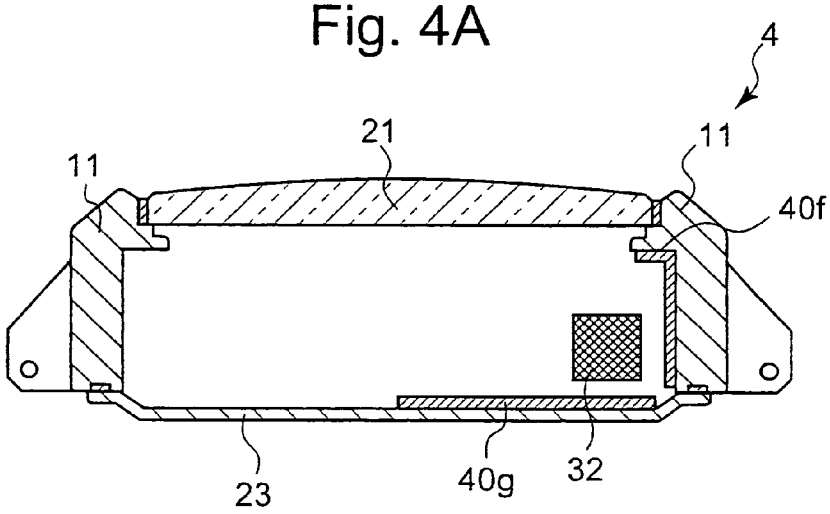
FIG. 4A is a schematic longitudinal cross-sectional view of a wristwatch to which magnetic sheets are partly adhered.
Figure 4B:
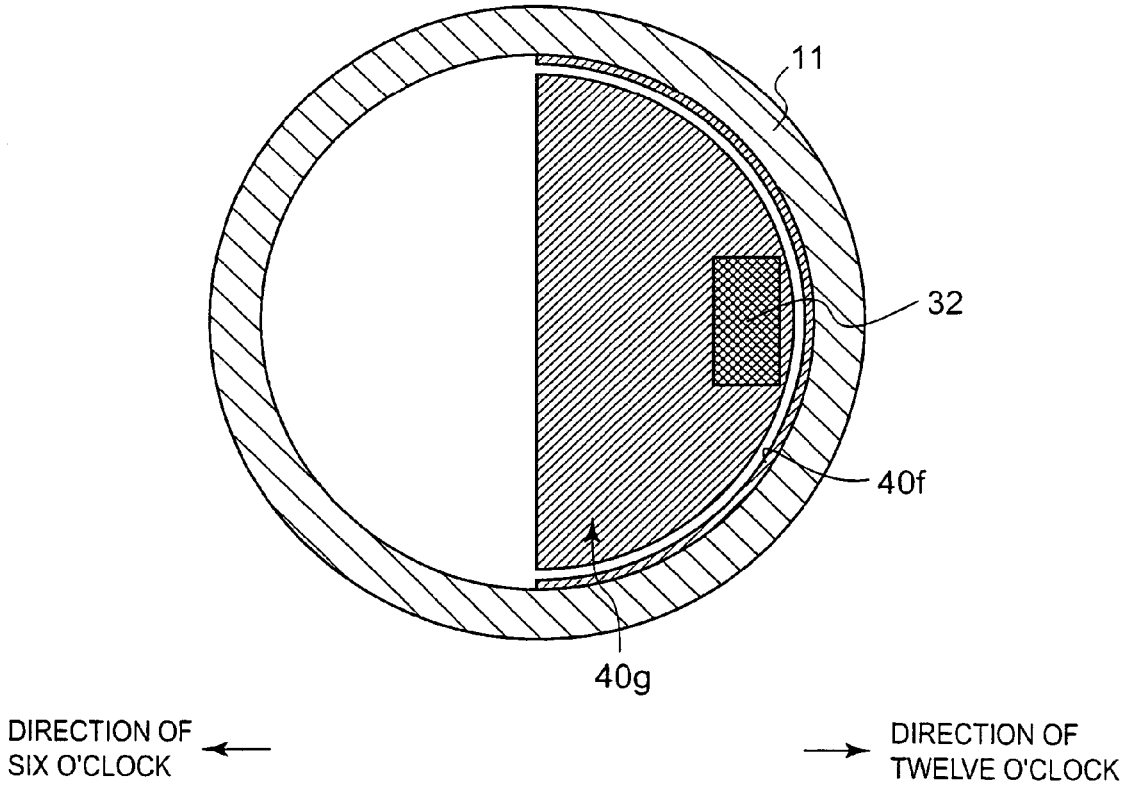
FIG. 4B is a schematic transverse cross-sectional view of the wristwatch.

FIGS. 4A and 4B are diagrams for explaining the layout positions and sizes of the magnetic sheets partially arranged in a wristwatch 4. FIG. 4A is a schematic longitudinal cross-sectional view of the wristwatch 4, and FIG. 4B is a schematic transverse cross-sectional view of the wristwatch 4. For the sake of descriptive simplicity, the watch module 31, the face 33, etc. in the watch case 11 are not illustrated. Referring to the diagrams, magnetic sheets 40*f* and 40*g* are respectively adhered to the inner surface of the watch case 11 and the inner surface of the back cover 23 at those portions which are close to the antenna 32 (the right-hand side in the diagrams). As apparent from the illustration, the layout positions and sizes of the magnetic sheets may be adequately changed according to the distribution of the demagnetization field (flux) generated in the antenna 32.

(2) Adhesion Positions of Magnetic Sheets

Although the magnetic sheets 40*a* and 40*b* are adhered to the entire inner surface of the watch case 11 and the inner surface of the back cover 23 in the first embodiment, they may be adhered to the outer surface of the watch module 31.

Figure 5:
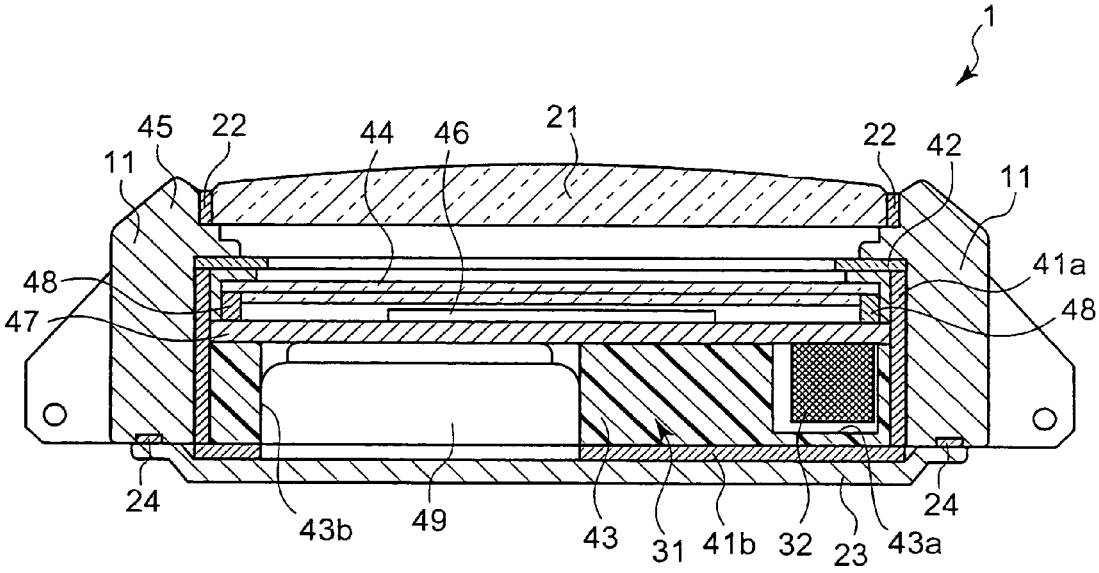
FIG. 5 is a schematic cross-sectional view of a wristwatch with magnetic sheets adhered to a watch module.

FIG. 5 is a diagram showing the wristwatch 1 with the magnetic sheets 41*a* and 41*b* adhered to the outer surface of the watch module 31. The wristwatch has the watch module 31 which digitally displays the time. The watch module 31 has an upper housing 42 of a synthetic resin and a lower housing 43 of a synthetic resin. A liquid crystal display 44 is retained in the upper housing 42, and a panel cover 45 for viewing the exposed region of the liquid crystal display 44. A circuit board 47 on which an IC chip 46 is mounted is laid out between the upper housing 42 and the lower housing 43. The top surface of the circuit board 47 is electrically connected to the liquid crystal display 44 via an interconnector 48, and the antenna 32 is attached to the bottom surface of the circuit board 47. An antenna retaining recess 43*a* for retaining the antenna 32 and a battery receiving hole 43*b* for receiving a battery are formed in the lower housing 43. Magnetic sheets 41*a* and 41*b* are adhered to the peripheral side surface and the bottom surface of the watch module 31, i.e., the top portion of the watch module 31 and the peripheral side surfaces of the upper and lower housings 42 and 43 and the bottom surface of the lower housing 43.

(3) Modification of Magnetic Member

While a magnetic sheet is used as a magnetic member in each embodiment discussed above, the magnetic member is not limited to a sheet type, but a rigid magnetic member may be used. For example, a synthetic resin having a magnetic material mixed therein and patterned into a predetermined shape may be used. The magnetic member may be molded into a frame shape to cover the module.

Fourth Embodiment

Structure of Wristwatch

Figure 6:
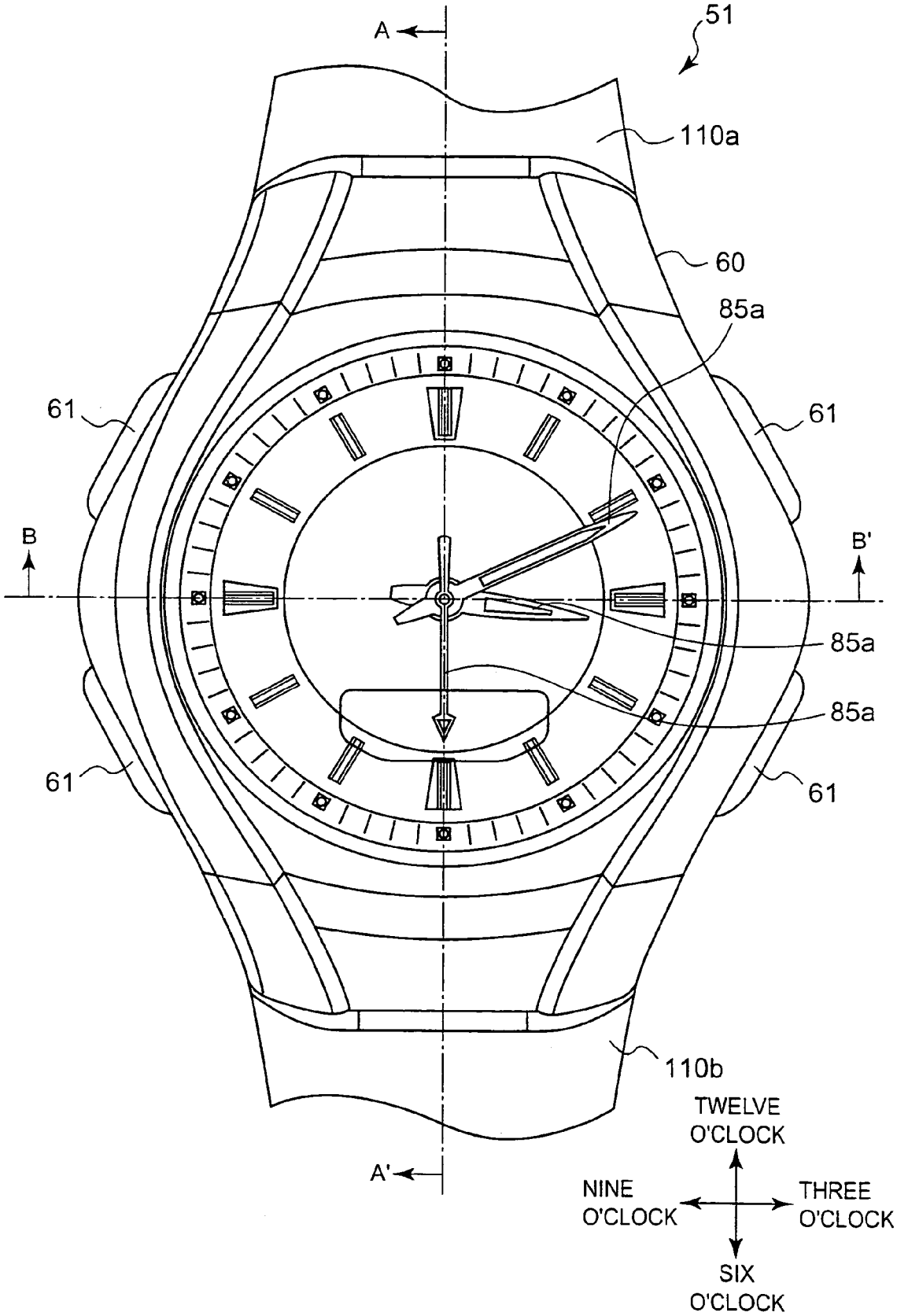
FIG. 6 is a plan view of a wristwatch according to a fourth embodiment of the invention.

FIG. 6 is a plan view of a wristwatch 51 according to the fourth embodiment. As shown in the diagram, the wristwatch 51 has a watch case 60 as a device case. Attached to the peripheral portion of the watch case 60 at the positions of 6 o'clock and 12 o'clock are watch bands 110*a* and 110*b* for mounting the watch case 60 to the arm of a user. A switch 61 for instructing execution of various functions of the wristwatch 51 is provided at the outer side surface of the watch case 60.

Figure 7:
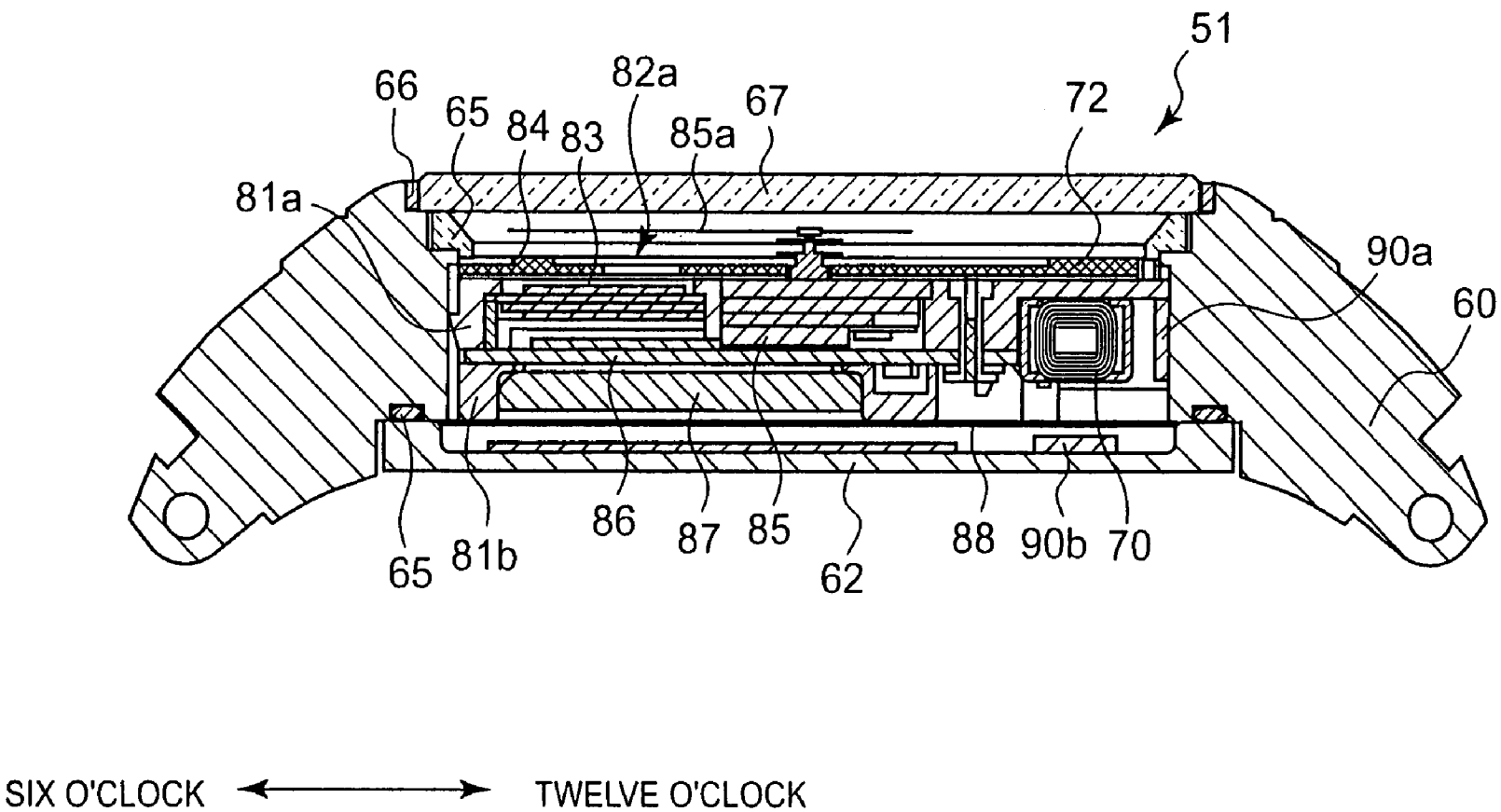
FIG. 7 is a cross-sectional view of the wristwatch in FIG. 6 along a 12-6 o'clock line.
Figure 8:
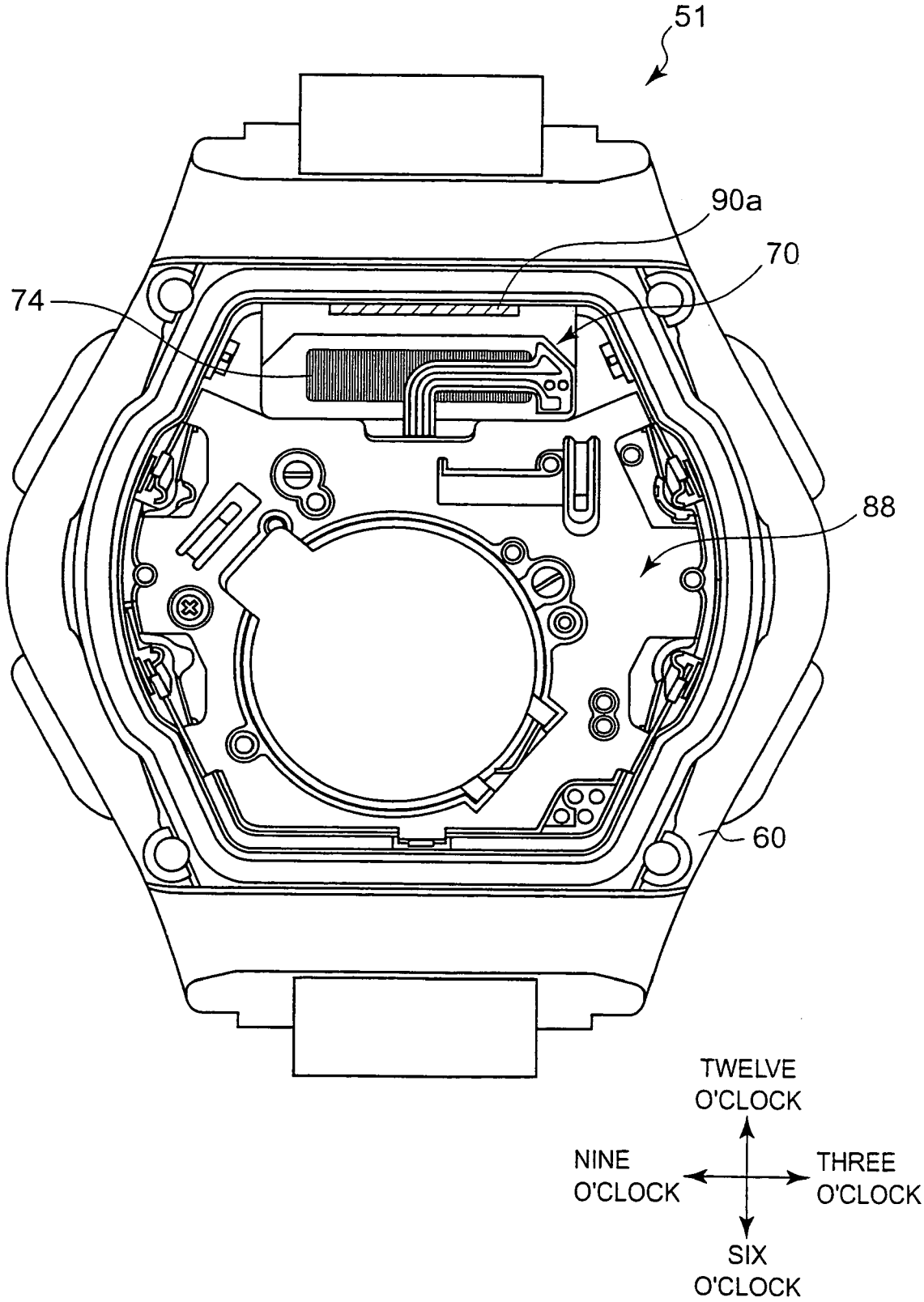
FIG. 8 is a back view of the wristwatch in FIG. 6.

FIG. 7 is a cross-sectional view of the wristwatch 51 as seen from arrows A and A' (cross-sectional view along the 12-6 o'clock line), and FIG. 8 is a back view of the wristwatch 51. FIG. 8 shows a back cover 62 and a part of a circuit presser 88 lying under the lower portion of an antenna 70 in a see-through fashion. As shown in FIGS. 7 and 8, the watch case 60 is formed of a metal, such as stainless steel or titanium, in an annular short column shape. Extending portions for attachment of the watch bands 110*a* and 110*b* are formed at outer side portions of the watch case 60 at the positions of 6 o'clock and 12 o'clock, and holes for insertion of pins to attach the watch bands 110*a* and 110*b* are formed in the extending portions.

Fitted in the upper end portion of the watch case 60 (top side in FIG. 7) via a packing 66 is a watch glass 67 which shields an opening in the upper end portion. The back cover 62 which shields an opening in the lower end portion of the watch case 60 (bottom side in FIG. 7) is attached to the lower end portion via an O ring 63. The back cover 62 is formed of a strong metal, such as stainless steel or titanium, into a thin flat shape.

A watch module and magnetic members 90*a* and 90*b* are disposed inside the watch case 60. The watch module has an upper housing 81*a* and a lower housing 81*b*. A solar cell 84 is disposed at the top surface of the upper housing 81*a*, and a face 82 is located above the solar cell 84. A ring-like panel cover 65 is arranged at the top surface of the face 82. A liquid crystal panel 83 which displays the time or so is placed under an opening 82*a* formed at the face 82 at a position close to the 6 o'clock position and supported by the upper housing 81*a*. That is, the wristwatch 51 is designed in such a way that as the wristwatch 51 is seen from the front, the time displayed on the liquid crystal panel 83 can be seen through the opening 82*a* formed in the face 82.

The upper housing 81*a* has an analog hand mechanism 85 and the antenna 70 which receives the standard radio wave, and a secondary battery 87 is built in the lower housing 81*b*. The analog hand mechanism 85 has a hand shaft extending upward from a shaft hole formed in the center portion of the face 82 and hands 85*a*, such as an hour hand and a minute hand, attached to the hand shaft, and moves the hands 85*a* above the face 82.

Figure 9A:
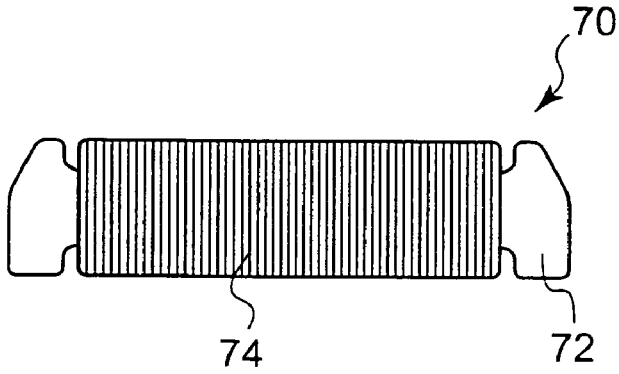
FIG. 9A is a diagram showing the structure of an antenna.

As shown in a plan view of FIG. 9A, the antenna 70 has a rod-like core 72 formed of a magnetic material, such as ferrite or amorphous magnetic, a coil 74 formed by winding a conductive wire of copper or so around the center portion of the core 72 at a uniform thickness. The core 72 is formed in a square rod with a nearly rectangular cross section. Both end portions of the core 72 have shapes of the chopped-off outer corners of a rectangular parallelepiped whose cross-sectional areas are larger than that of the center portion.

Figure 9B:
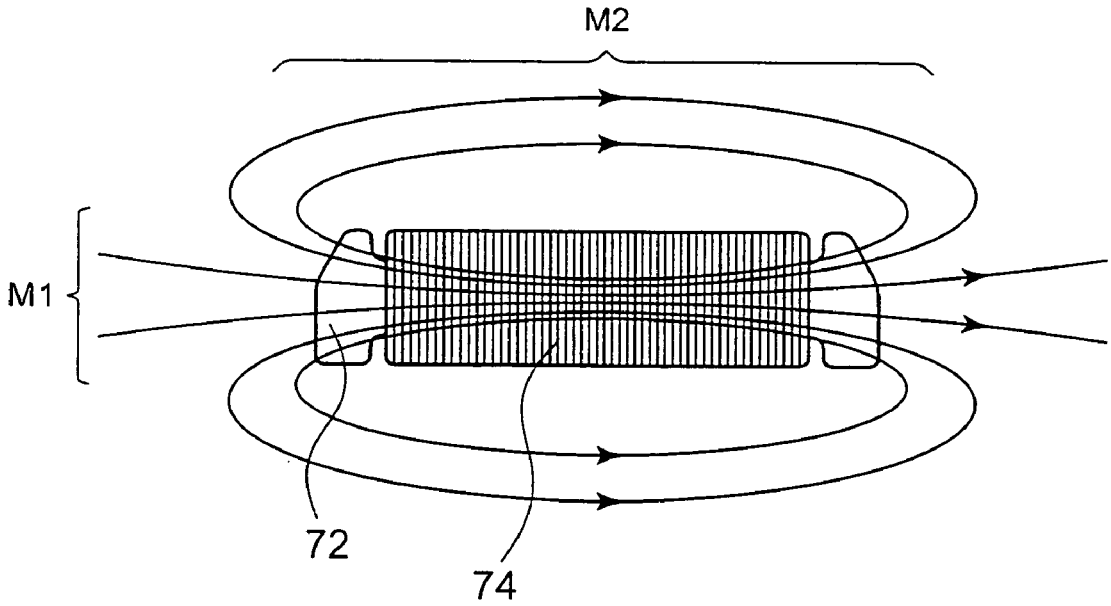
FIG. 9B is a diagram showing the distribution of a magnetic flux.

When the antenna 70 is placed in a magnetic field generated by the standard radio wave (hereinafter called "signal field"), as shown in FIG. 9B, the flux produced by the signal field (hereinafter called "signal flux") M1 is concentrated on the core 72 whose magnetic permeability is higher than the magnetic permeability of the surrounding space, and crosses the coil 74 in a chain fashion. Then, induced electromotive force V to generate a magnetic flux (hereinafter called "generated flux") M2 in the direction of interfering a change in signal flux M1 is generated in the coil 74. As the signal flux M1 is an AC signal whose amplitude and direction periodically change, the induced electromotive force V generated in the coil 74 becomes AC power, so that the generated flux M2 becomes an AC magnetic field whose size and direction periodically change in response to a time-dependent change in signal flux M1.

Figure 10:
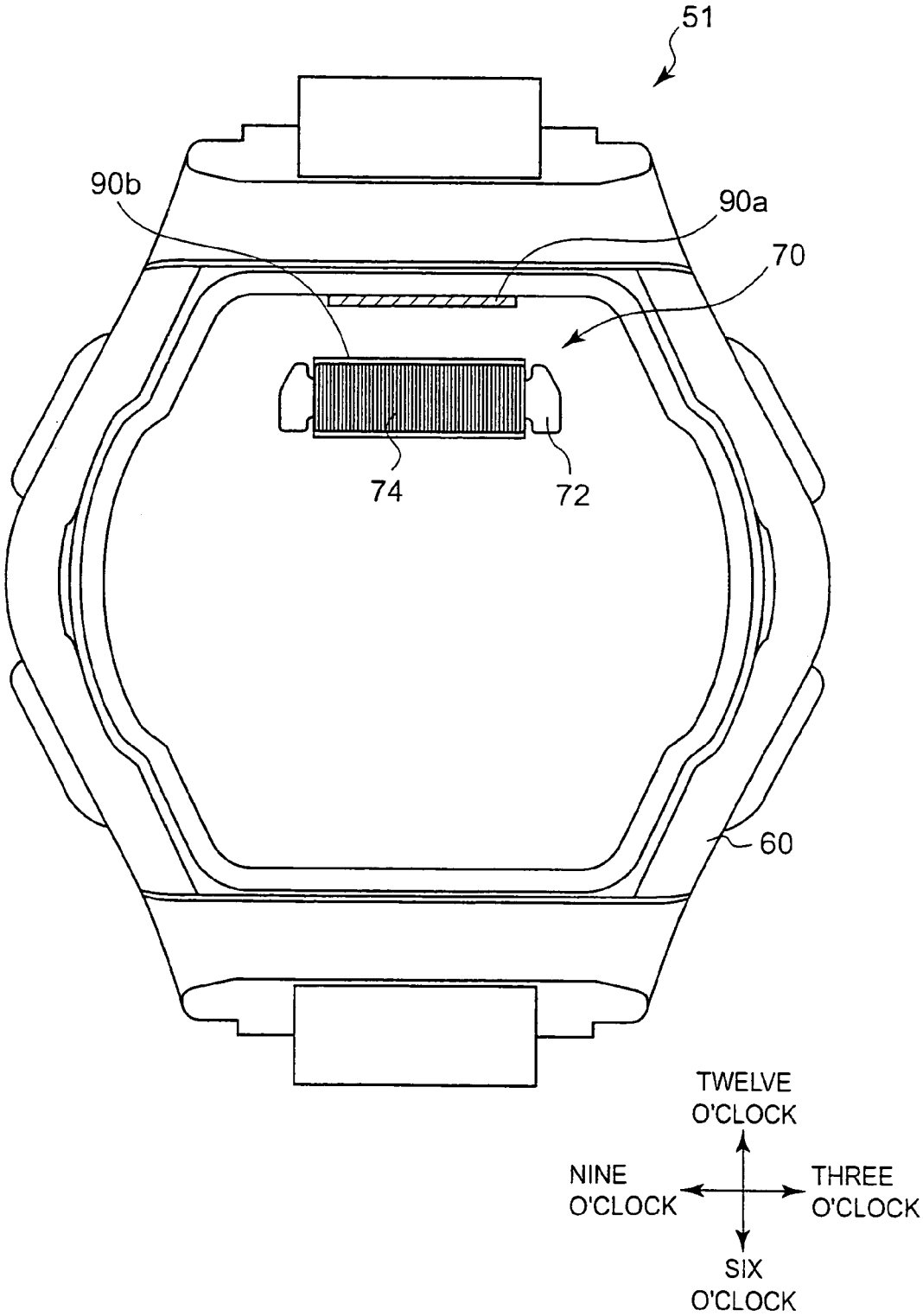
FIG. 10 is a schematic back view of the wristwatch showing the layout of the antenna and a magnetic member according to the fourth embodiment.

The antenna 70 is arranged in the watch case 60 as shown in FIG. 10. FIG. 10 is a schematic back view showing the essential portions of the wristwatch 51, and shows only the antenna 70 and the magnetic members 90*a* and 90*b* in the watch case 60 for easier understanding of the layout of the antenna 70 and the magnetic members 90*a* and 90*b*. Referring to FIG. 10, the antenna 70 is arranged at a position close to the 12 o'clock position (top side in the diagram) in such a way that the axial line of the core 72 is in parallel to the 3-9 o'clock direction and the chopped surfaces formed at both end portions of the core 72 face the inner surface of the watch case 60. The antenna 70 is laid out in such a way that both end portions of the core 72 are supported by the upper housing 81*a* and there is a clearance between the inner surface of the watch case 60 and the top surface of the back cover 62 (the surface facing the inner side of the watch case 60).

As shown in FIG. 7, an LSI board 86 which connects the analog hand mechanism 85, the liquid crystal panel 83, the antenna 70 and the like and controls them is laid between the upper housing 81*a* and the lower housing 81. Circuit elements the LSI board 86 has include a control IC, such as a CPU, a reception circuit which is electrically connected to the coil 74 of the antenna 70 by a lead wire of copper or so to detect the induced electromotive force V, generated in the coil 74, amplify and demodulate the detected electric signal, and acquire time data (i.e., time code) included in the standard radio wave, and a timing circuit having an oscillator to measure the current time. The control IC performs processes, such as correcting the time measured by the timing circuit based on the time data acquired by the reception circuit and displaying the corrected current time on the liquid crystal panel 83, or controlling the analog hand mechanism 85 to move the hands 85*a* to indicate the corrected current time.

The magnetic members 90*a* and 90*b* are formed of a magnetic material having a magnetic permeability higher (greater) than the magnetic permeabilities of the watch case 60 and the back cover 62 and lower (smaller) than the effective magnetic permeability of the antenna 70. The magnetic members 90*a* and 90*b* are formed like an approximately rectangular thin plate whose length in the lengthwise direction is nearly equal to (or may be slightly shorter than) the axial length L of the coil 74 and whose length in the direction of the short side is nearly equal to the width, W, of the coil 74.

The magnetic member 90*a* is provided in tight contact with the inner surface of the watch case 60 at a position close to the 12 o'clock position in the watch case 60. In detail, the magnetic member 90*a* is provided at the position facing the coil 74 of the antenna 70 with its lengthwise direction being in parallel to the axial direction of the coil 74. That is, the magnetic member 90*a* is provided between the antenna 70 and the watch case 60. The antenna 70 is laid out with a clearance to the magnetic member 90*a*.

Figure 12:
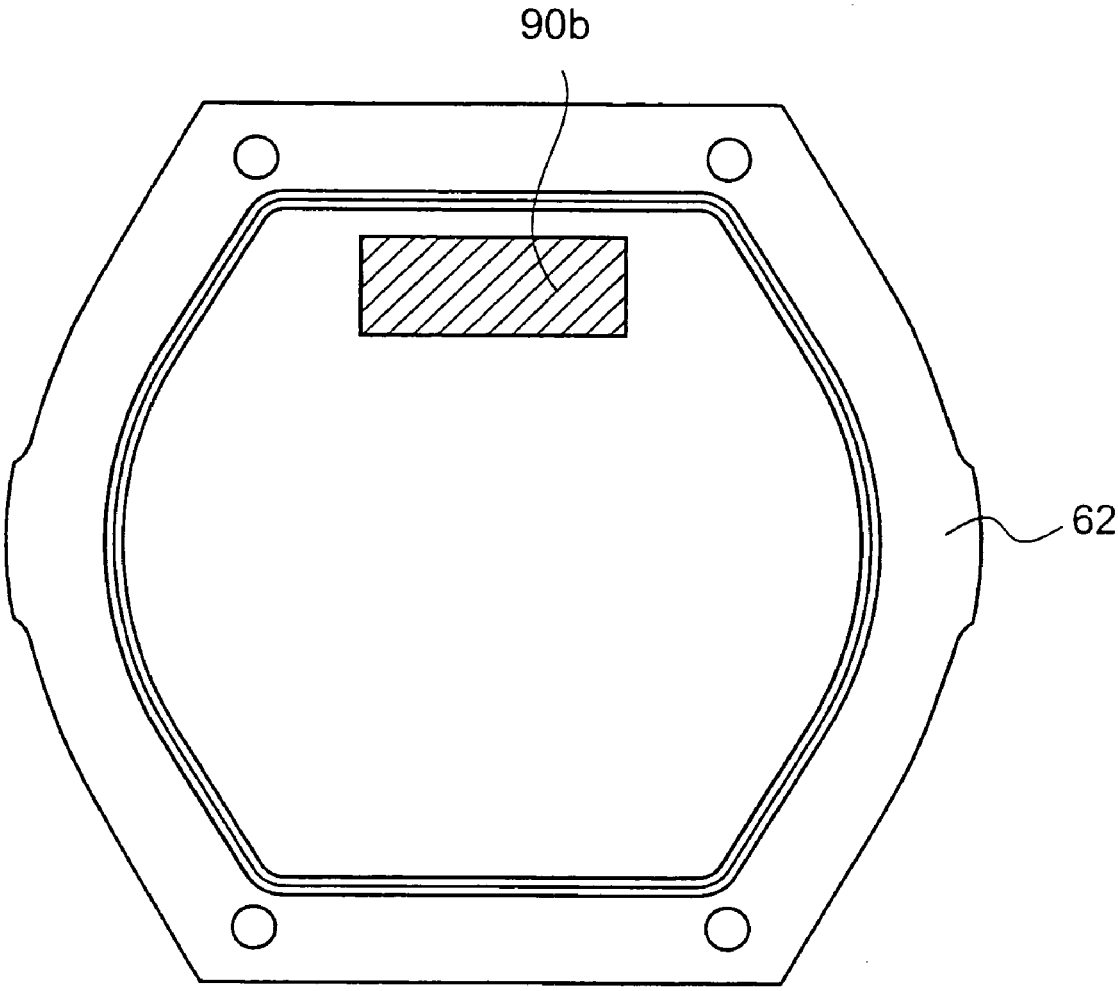
FIG. 12 is a plan view of a back cover.

The magnetic member 90*b* is provided in tight contact with the inner surface of the back cover 62 at a position close to the 12 o'clock position in the watch case 60, as shown in FIG. 12. FIG. 12 is a diagram showing the positional relationship between the back cover 62 and the magnetic member 90*b*. Specifically, the magnetic member 90*b* is provided at the position facing the coil 74 of the antenna 70 with its lengthwise direction being in parallel to the axial direction of the coil 74. That is, the magnetic member 90*b* is provided between the antenna 70 and the back cover 62. The antenna 70 is laid out with a clearance to the magnetic member 90*b*.

As the magnetic members 90*a* and 90*b* are formed in such a way that the length in the lengthwise direction is nearly equal to (or slightly shorter than) the length L of the coil 74, the magnetic members 90*a* and 90*b* do not face both end portions of the core 72 (the portions where the coil 74 is not wound). This suppresses the degrading of the reception sensitivity of the antenna 70 which would be caused as the signal flux M1 is attracted to the magnetic members 90*a* and 90*b* and pass the magnetic members 90*a* and 90*b*.

Distribution of Magnetic Flux

Figure 13:
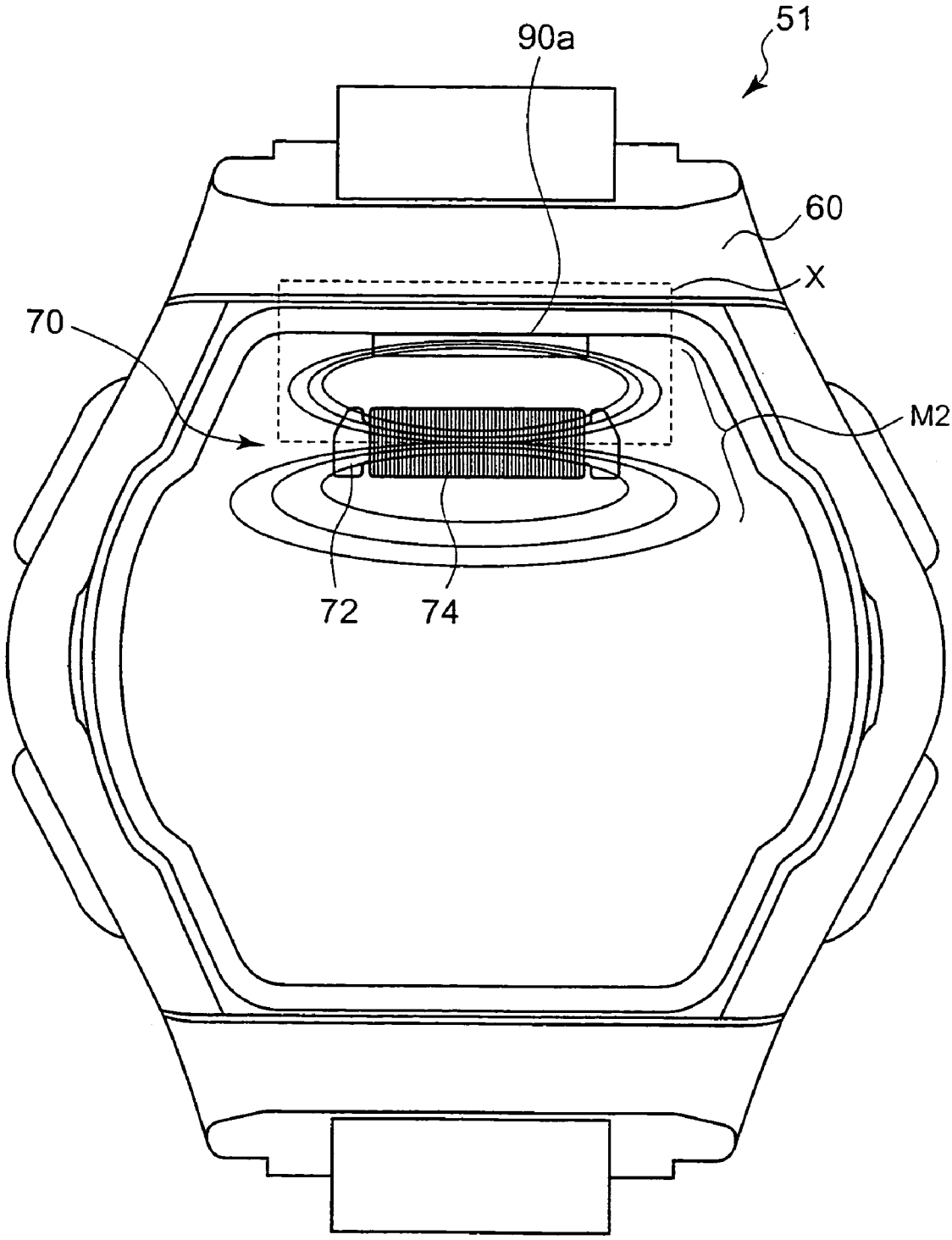
FIG. 13 is a diagram showing a flux distribution diagram (1) according to the fourth embodiment.
Figure 14:
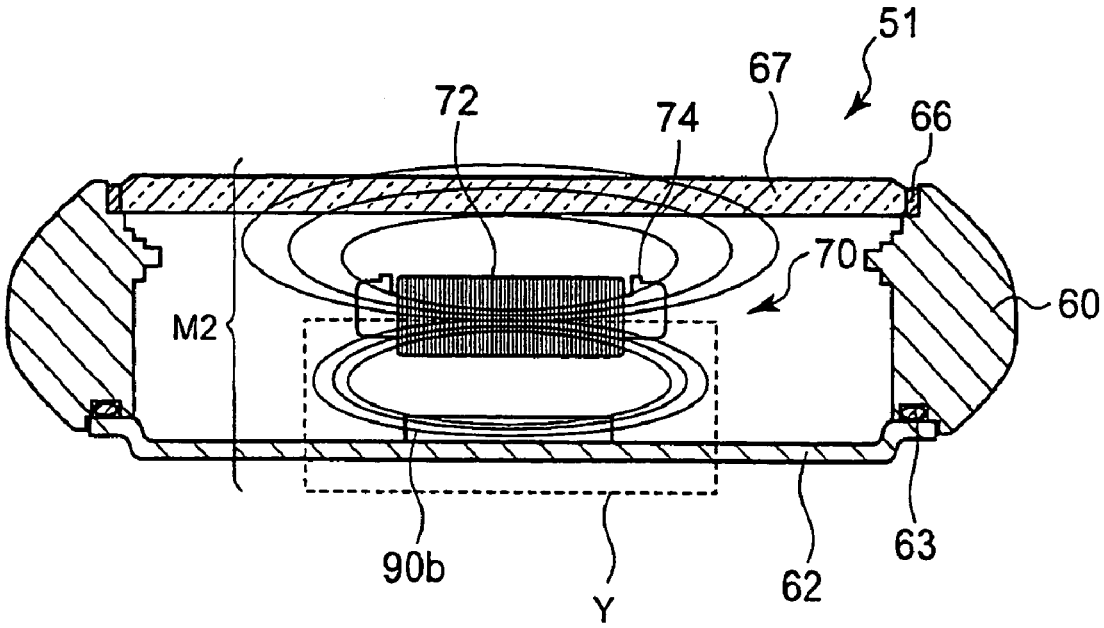
FIG. 14 is a diagram showing a flux distribution diagram (2) according to the fourth embodiment.

The magnetic flux (generated flux) M2 generated in the antenna 70 with respect to the signal field is distributed as shown in FIGS. 13 and 14 in the thus constituted wristwatch 51.

FIGS. 13 and 14 are diagrams showing the distribution of the generated flux M2. FIG. 13 shows the back view of the essential portions of the wristwatch 51, and FIG. 14 shows a schematic cross-sectional view of the wristwatch 51 along the line B-B' (cross-sectional view along the 3-9 o'clock line). FIGS. 13 and 14 show only the antenna 70 and the magnetic members 90*a* and 90*b* in the watch case 60 for easier understanding of the distribution of the magnetic flux.

In general, the magnetic flux is distributed in such a way that the magnetic resistance takes as small a path as possible. As shown in FIG. 13, therefore, in the space X in which the antenna 70 including the magnetic member 90*a* faces the inner surface of the watch case 60, that magnetic flux in the generated flux M2 which corresponds to a portion facing the magnetic member 90*a* passes the magnetic member 90*a* having a lower magnetic resistance and hardly passes the watch case 60 because of the magnetic permeability of the magnetic member 90*a* being higher than the magnetic permeability of the watch case 60.

As shown in FIG. 14, in the space Y in which the antenna 70 including the magnetic member 90*b* faces the top surface of the back cover 62, that magnetic flux in the generated flux M2 which corresponds to a portion facing the magnetic member 90*b* passes the magnetic member 90*b* having a lower magnetic resistance and hardly passes the back cover 62 because of the magnetic permeability of the magnetic member 90*b* being higher than the magnetic permeability of the back cover 62.

As there is a very few magnetic flux that passes through the watch case 60 and the back cover 62, the eddy current that is produced by the magnetic flux passing thorough a metal is hardly generated in the watch case 60 and the back cover 62. Because the eddy current loss by the generated flux M2 hardly occurs, therefore, the degradation (reduction) of the reception sensitivity of the antenna 70 originated from the watch case 60 and the back cover 62 is suppressed.

As the magnetic members 90*a* and 90*b* are formed in such a way that their lengths are slightly shorter than (or equal to) the length L of the coil 74 and are so arranged as not to face both end portions of the core 72, the signal flux M1 that should originally pass the core 72 are attracted to the magnetic members 90*a* and 90*b* and hardly pass the magnetic member 90*a* and 90*b*. In other words, the arrangement of the magnetic members 90*a* and 90*b* does not reduce the reception sensitivity of the antenna 70.

Magnetic Permeability of Magnetic Member

Figures 15A, 15B:
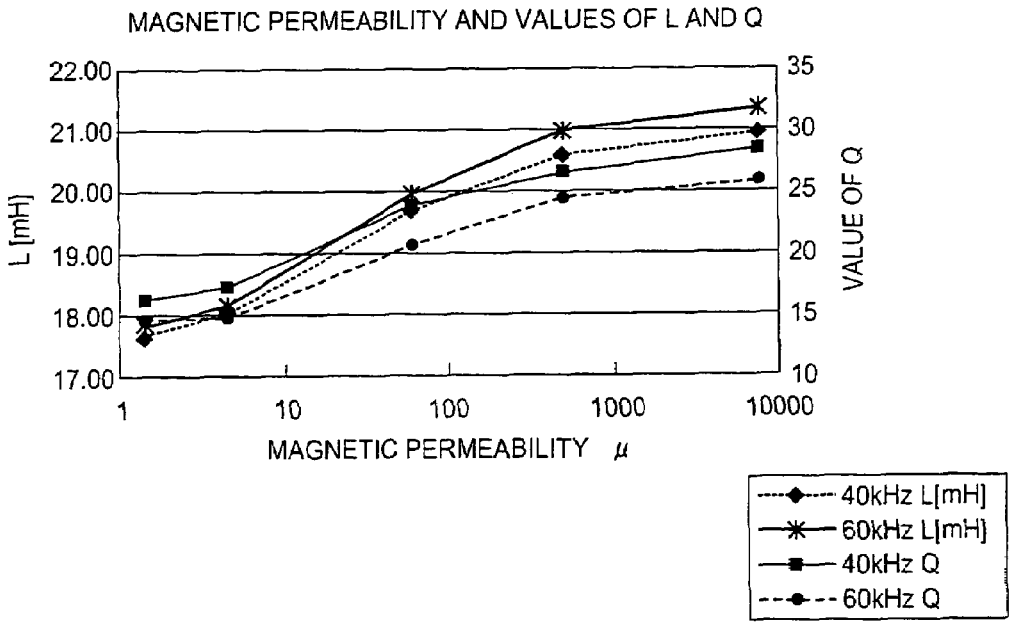
FIGS. 15A and 15B are diagrams showing measurements as the magnetic permeability of the magnetic member is changed.

FIGS. 15A and 15B are diagrams showing measurements when the magnetic members 90*a* and 90*b* are formed of magnetic materials with different magnetic permeabilities. While the magnetic permeability of the core material of the antenna 70 is "8000" or so, the effective magnetic permeability of the antenna 70 using this core material is (the magnetic permeability measured with the coil wound around the core) is "100" or so. The magnetic permeability of the metal of which the watch case 60 and the back cover 62 are formed is about "1.0" to "1.2".

FIG. 15A is a measuring result table showing the values of the measurements, and shows the measuring conditions in association with the measuring results. In the diagram, there are six measuring conditions: (1) without the magnetic members 90*a* and 90*b*, (2) the magnetic permeability μ="1.4", (3) μ="4.5", (4) μ="60", (5) μ="500" and (6) μ="8000".

The inductance L of the antenna 70, the resonance resistance Z and the reception sensitivity of the antenna 70 were measured for each of the cases where standard radio waves of 40 kHz and 60 kHz were received. The table also shows Q values computed from the measured inductance L and resonance resistance Z according to the following equation 1.

$$Q=Z/(2\pi fL) \quad (1)$$

In the equation 1, f is the frequency of the received standard radio wave (i.e., 40 kHz or 60 kHZ).

FIG. 15B is a graph obtained from the measuring result table in FIG. 15A, with the horizontal axis showing the magnetic permeability μ as the measuring condition while the vertical axis shows the inductance L and Q value of the antenna 70 plotted when the standard radio wave of each of 40 kHz and 60 kHz was received.

In general, the inductance L, the resonance resistance Z, the Q value and the reception sensitivity are proportional to the magnetic permeability μ. In case of the antenna 70 installed in the wristwatch 51, the reception sensitivity saturates with the value n of a certain magnetic permeability μ as a threshold. That is, in the case illustrated in the diagram, while each of the inductance L, the resonance resistance Z and the Q value is approximately proportional to the magnetic permeability μ, the reception sensitivity saturates with the magnetic permeability μ="60" as the threshold value.

Figure 16:
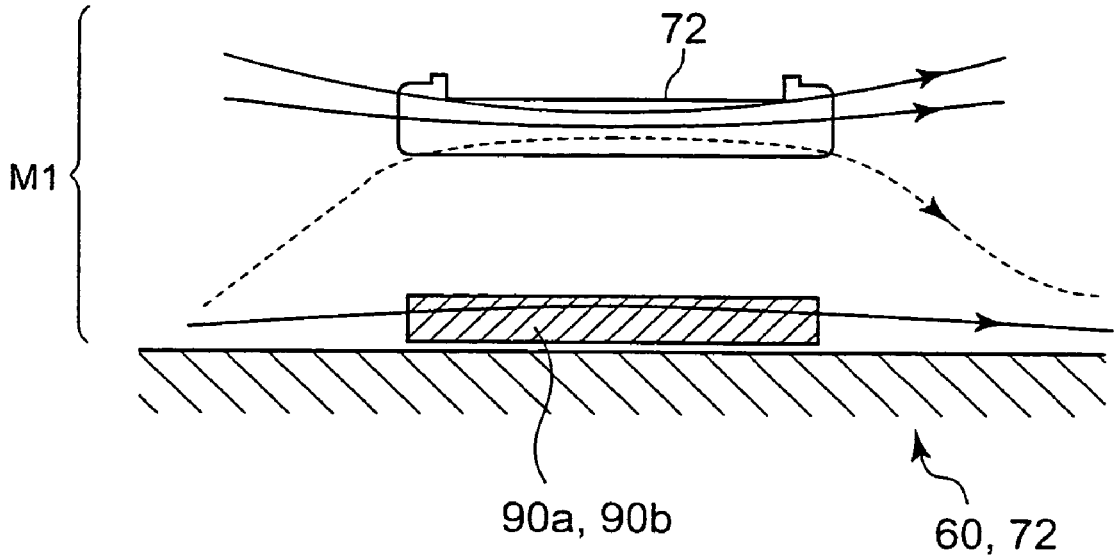
FIG. 16 is a diagram showing a change in flux distribution caused by the magnetic permeability of the magnetic member.

This is because, as shown in FIG. 16, when the magnetic permeability μ of the magnetic material forming the magnetic members 90*a* and 90*b* becomes a certain level or higher, the signal flux M1 that should have passed the core 72 as indicated by the broken line in the diagram is attracted to the magnetic members 90*a* and 90*b* and pass through the magnetic members 90*a* and 90*b*, not the core 72. The value n of the magnetic permeability which becomes the threshold for the saturation of the reception sensitivity is determined by the structure of the wristwatch 51, specifically, for example, the size of the antenna 70, the positional relationship (gaps) of the antenna 70, the watch case 60 and the back cover 62, the magnetic permeability of the metal of which the watch case 60 and the back cover 62 is made.

Operation and Effect

According to the fourth embodiment, as apparent from the above, because the magnetic member 90*a* is arranged at the inner surface of the watch case 60 formed of a metal and the magnetic member 90*b* is arranged at the inner surface of the back cover 62 formed of a metal, the generated flux M2 generated in the antenna 70 passes the magnetic members 90*a* and 90*b* having lower magnetic resistances and hardly pass the watch case 60 and the back cover 62. Therefore, the eddy current loss originating from the magnetic flux passing through the metals of the watch case 60 and the back cover 62 hardly occurs, thereby suppressing the degradation (reduction) of the reception sensitivity of the antenna 70.

That is, when the antenna 70 is realized by, for example, a bar antenna, a magnetic flux (generated flux) which interferes a time-dependent change in magnetic flux passing in the coil is generated in the antenna 70, at which time the generated flux is distributed so as to take a path with a lower magnetic resistance. That is, the generated flux generated in the antenna 70 passes the magnetic members 90*a* and 90*b* laid between the device case and the antenna 70 and hardly passes the watch case 60 as the device case. Therefore, the eddy current loss that would be caused by the generated flux passing the device case when the device case is formed of a metal, and the reception sensitivity of the antenna is suppressed. Because the magnetic permeability of each of the magnetic members 90*a* and 90*b* is lower than the effective magnetic permeability of the antenna, it is possible to prevent the degrading of the reception sensitivity of the antenna 70 which would otherwise occur as the signal flux that should pass the core of the antenna 70 pass the magnetic members 90*a* and 90*b*.

Fifth Embodiment

The fifth embodiment will be described below.

To avoid the redundant description, like or same reference numerals are given to those components of the fifth embodiment which are the same as the corresponding components of the fourth embodiment.

Structure of Wristwatch

Figure 17:
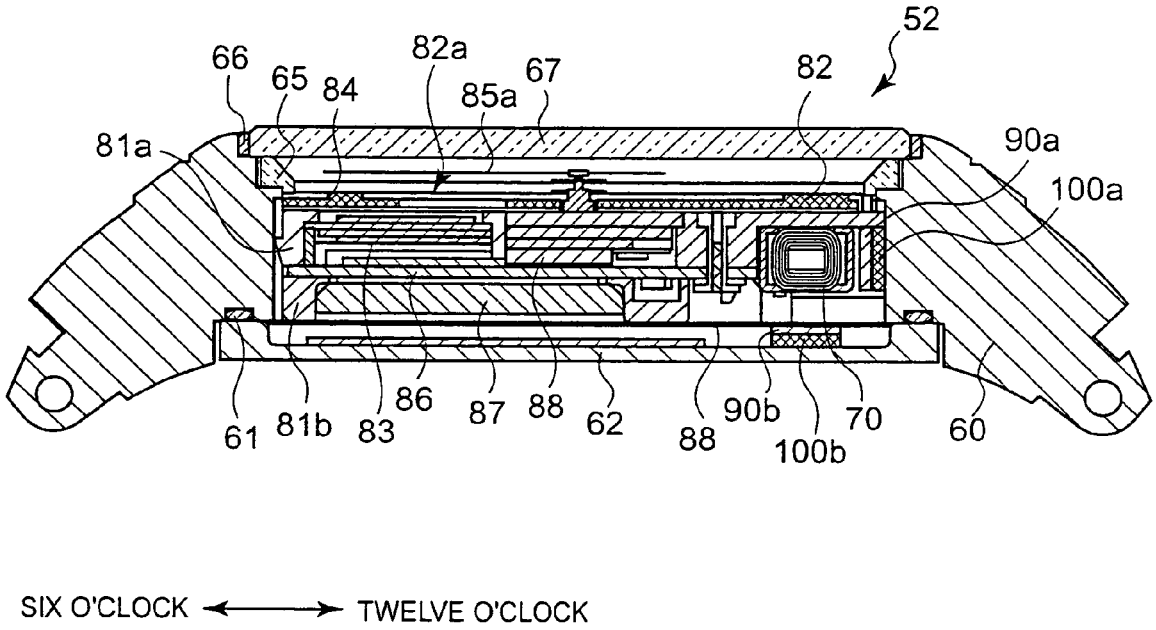
FIG. 17 is a cross-sectional view of a wristwatch according to a fifth embodiment of the invention along a 12-6 o'clock line.
Figure 18:
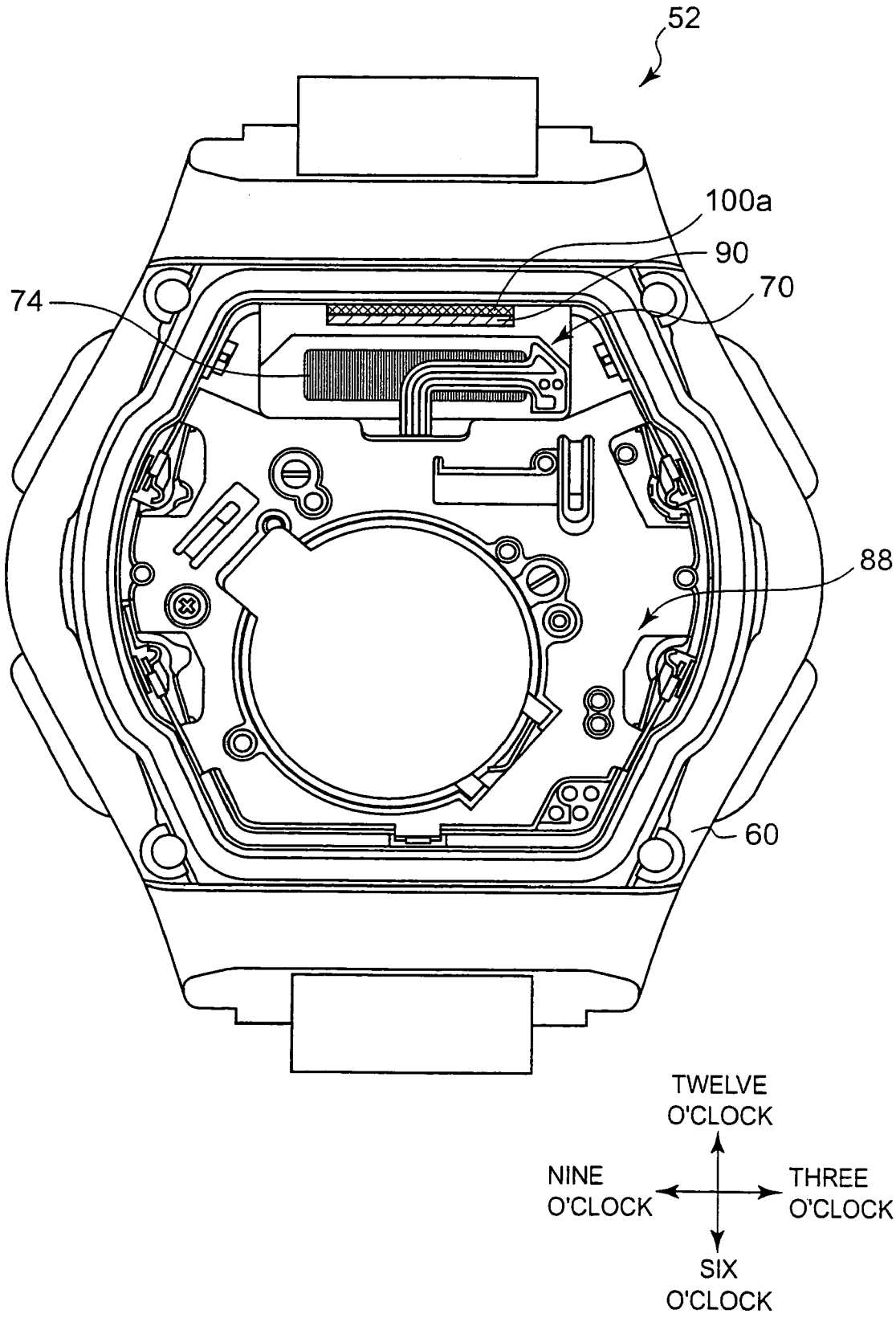
FIG. 18 is a back view of the wristwatch according to the fifth embodiment.

FIG. 17 is a cross-sectional view of a wristwatch 52 according to the fifth embodiment along the 12-6 o'clock line. FIG. 18 is a back view of the wristwatch 52. FIG. 17 shows the back cover 62 and a part of the circuit presser 88 lying under the lower portion of the antenna 70 in a see-through fashion. As shown in FIGS. 17 and 18, a watch module, the magnetic members 90*a* and 90*b* and non-magnetic conductive members 100*a* and 100*b* which are flux resilience members are disposed inside the watch case 60.

Figure 11:
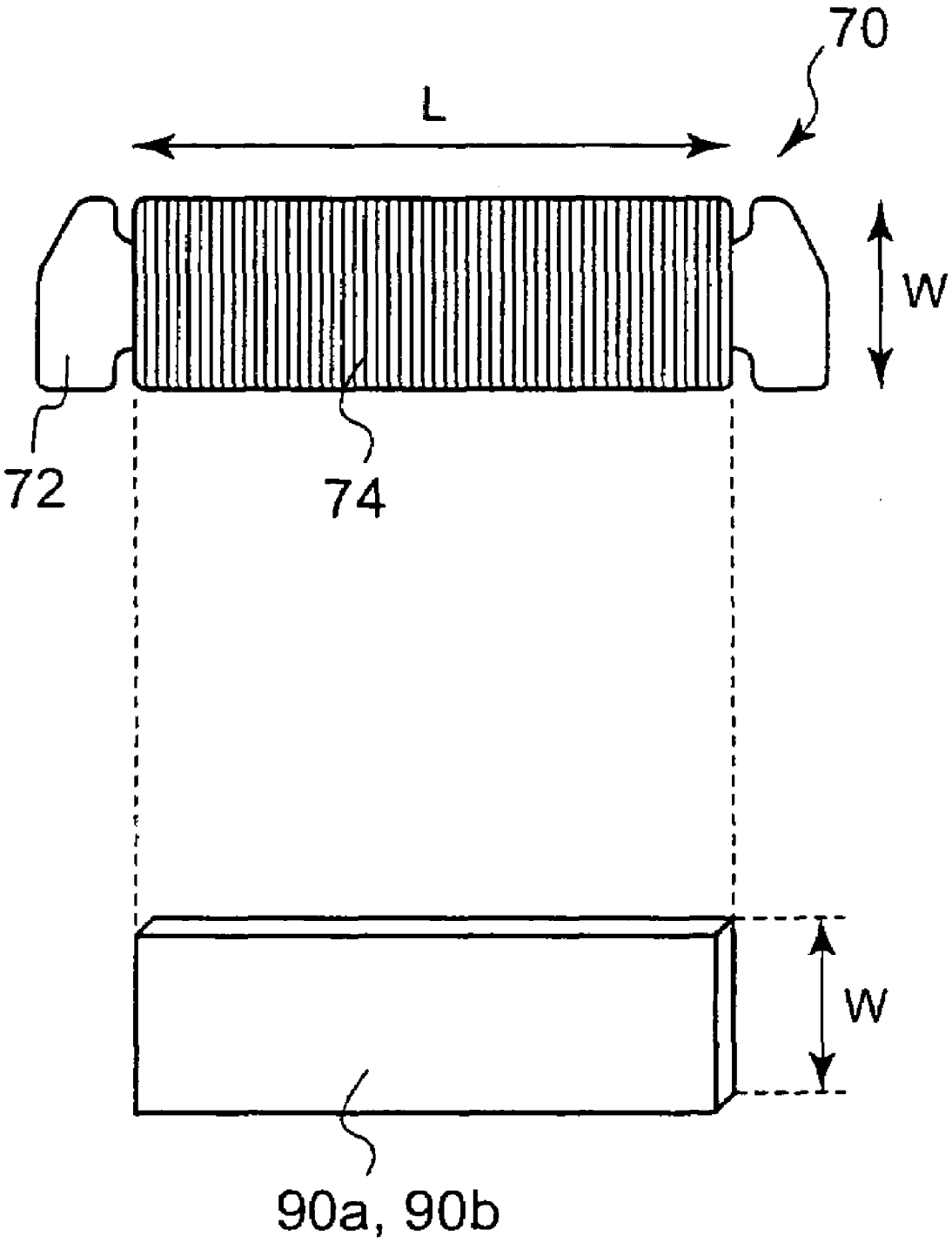
FIG. 11 is a structural diagram of the magnetic member.

The non-magnetic conductive members 100*a* and 100*b* are formed of a non-magnetic conductive material whose magnetic permeability is higher than 1 but lower than the magnetic permeabilities of the magnetic members 90*a* and 90*b* and whose electric conductivity is higher than the electric conductivities of the watch case 60 and the back cover 62. While the non-magnetic conductive materials include, for example, gold, copper, titanium and aluminum, the magnetic permeability of titanium is 1.001 and the magnetic permeability of aluminum is 1.00002. The non-magnetic conductive members 100*a* and 100*b* are formed into approximately the same shapes as the magnetic members 90*a* and 90*b*; i.e., their lengths in the lengthwise direction are nearly equal to (or slightly shorter than) the axial length L of the coil 74 and their lengths in the direction of the short side are nearly equal to the width W of the coil 74, as shown in FIG. 11.

Figure 19:
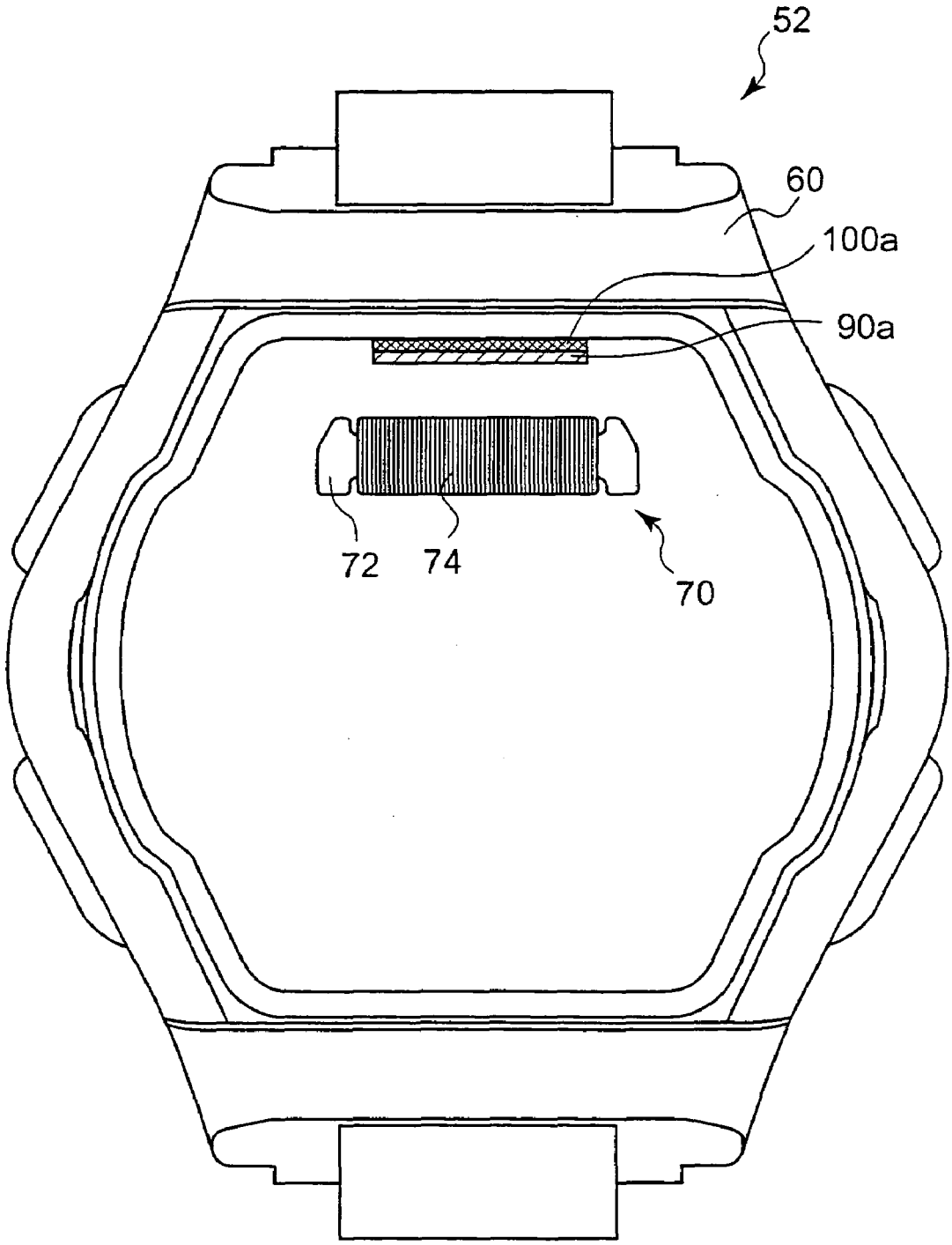
FIG. 19 is a schematic back view showing the layout of an antenna, a magnetic member and a non-magnetic conductive member according to the fifth embodiment.

The non-magnetic conductive member 100*a* is provided in tight contact with the inner surface of the watch case 60 at a position close to the 12 o'clock position in the watch case 60, as shown in FIG. 19. FIG. 19 is a schematic back view showing the essential portions of the wristwatch 52, and shows only the antenna 70, the magnetic member 90*a* and the non-magnetic conductive member 100*a* inside the watch case 60 for easier understanding of the layout of the antenna 70, the magnetic member 90*a* and the non-magnetic conductive member 100*a* inside the watch case 60. More specifically, the non-magnetic conductive member 100*a* is provided at the position facing the coil 74 of the antenna 70 with its lengthwise direction being in parallel to the axial direction of the coil 74. The magnetic member 90*a* is provided in tight contact with the non-magnetic conductive member 100*a* so as to overlie the top surface of the non-magnetic conductive member 100*a*. That is, the non-magnetic conductive member 100*a* is provided between the watch case 60 and the magnetic member 90*a*. There is a clearance formed between the magnetic member 90*a* and the antenna 70.

The non-magnetic conductive member 100*b* is provided in tight contact with the inner surface of the back cover 62. More specifically, the non-magnetic conductive member 100*b* is provided at the position facing the coil 74 of the antenna 70 with its lengthwise direction being in parallel to the axial direction of the coil 74. The magnetic member 90*b* is provided in tight contact with the non-magnetic conductive member 100*b* so as to overlie the top surface of the non-magnetic conductive member 100*b*. That is, the non-magnetic conductive member 100*b* is provided between the back cover 62 and the magnetic member 90*b*. There is a clearance formed between the magnetic member 90*b* and the antenna 70.

Distribution of Magnetic Flux

Figure 20:
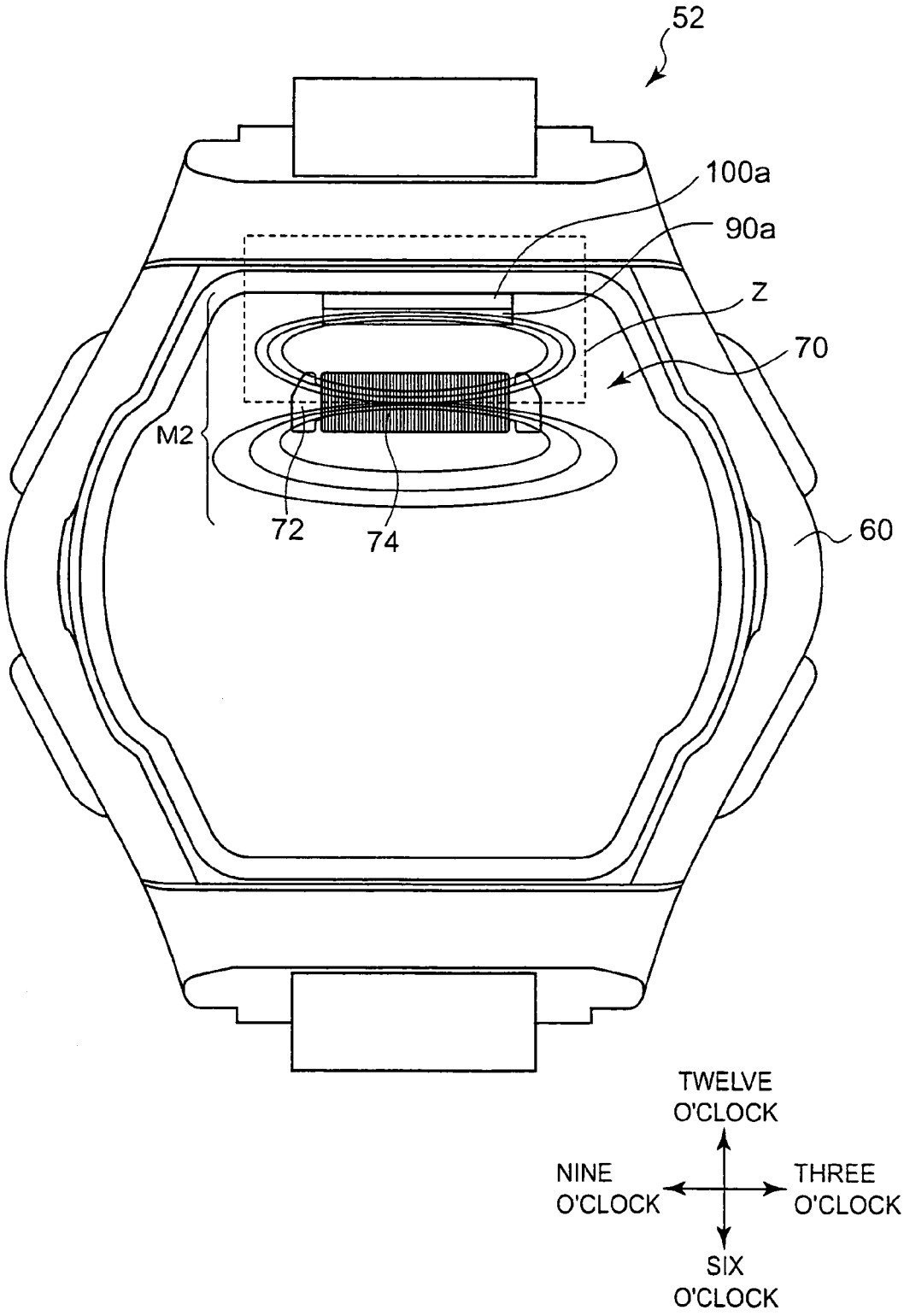
FIG. 20 is a diagram showing a flux distribution diagram (1) according to the fifth embodiment.
Figure 21:
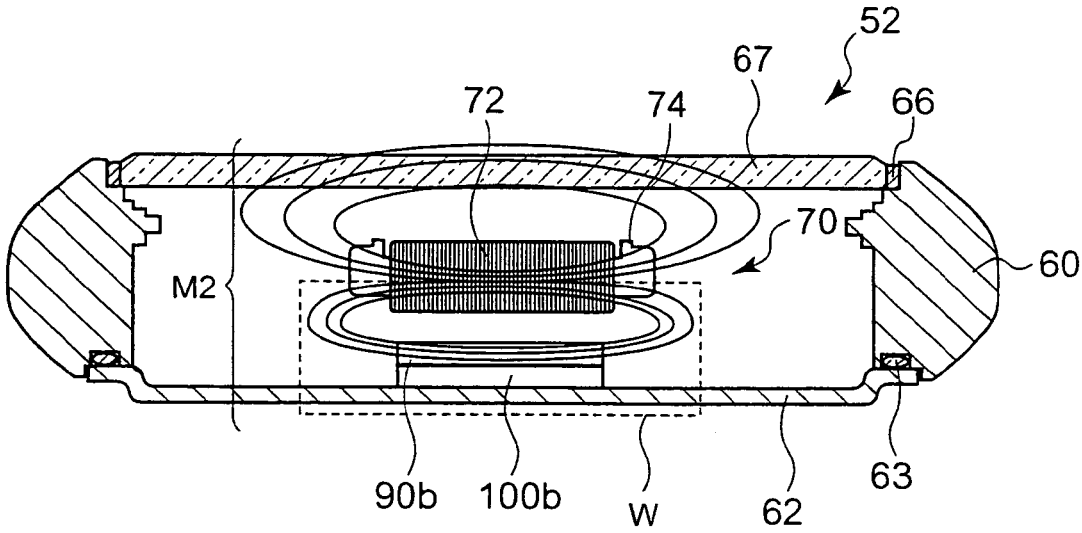
FIG. 21 is a diagram showing a flux distribution diagram (2) according to the fifth embodiment.

FIGS. 20 and 21 are diagrams showing the distribution of the generated flux M2 in the wristwatch 52. FIG. 20 shows the back view of the essential portions of the wristwatch 52, and FIG. 21 shows a schematic cross-sectional view of the wristwatch 52 along the 3-9 o'clock line. FIGS. 20 and 21 show only the antenna 70, the magnetic members 90*a* and 90*b* and the non-magnetic conductive members 100*a* and 100*b* in the watch case 60 for easier understanding of the distribution of the magnetic flux.

As shown in FIG. 20, therefore, in the space Z in which the non-magnetic conductive member 100*a*, the antenna 70 including the non-magnetic conductive member 100*a* face the inner surface of the watch case 60, that magnetic flux in the generated flux M2 which corresponds to a portion facing the magnetic member 90*a* passes the magnetic member 90*a* having a lower magnetic resistance because of the magnetic permeability of the magnetic member 90*a* being higher than the magnetic permeabilities of the watch case 60 and the non-magnetic conductive member 100*a*.

The non-magnetic conductive member 100*a* has a property to repel the magnetic flux. Therefore, that magnetic flux in the generated flux M2 which attempts to cross the magnetic member 90*a* and pass the watch case 60 is repelled by the non-magnetic conductive member 100*a* located between the magnetic member 90*a* and the watch case 60, and eventually passes the magnetic member 90*a*. This considerably reduces the magnetic flux passing through the watch case 60.

As shown in FIG. 21, in the space W in which the non-magnetic conductive member 100*b* and the antenna 70 including the magnetic member 90*b* face the inner surface of the back cover 62, that magnetic flux in the generated flux M2 which corresponds to a portion facing the magnetic member 90*b* passes the magnetic member 90*b* having a lower magnetic resistance because of the magnetic permeability of the magnetic member 90*b* being higher than the magnetic permeabilities of the back cover 62 and the non-magnetic conductive member 100*b*.

The non-magnetic conductive member 100*b* has a property to repel the magnetic flux. Therefore, that magnetic flux in the generated flux M2 which attempts to cross the magnetic member 90*b* and pass the back cover 62 is repelled by the non-magnetic conductive member 100*b* located between the magnetic member 90*b* and the back cover 62, and eventually passes the magnetic member 90*b*. Therefore, the magnetic flux that passes through the back cover 62 becomes significantly fewer.

In other words, as there is a very few magnetic flux that passes through the watch case 60 and the back cover 62, the eddy current that is produced by the magnetic flux passing thorough a metal is hardly generated. This suppresses the degradation (reduction) of the reception sensitivity of the antenna 70 originated from the watch case 60 and the back cover 62.

Operation and Effect

According to the fifth embodiment, as apparent from the above, because the non-magnetic conductive member 100*a* is arranged at the inner surface of the watch case 60 formed of a metal, the magnetic member 90*a* is arranged at the top surface of the non-magnetic conductive member 100*a*, the non-magnetic conductive member 100*b* is arranged at the inner surface of the back cover 62 formed of a metal, and the magnetic member 90*b* is arranged at the top surface of the non-magnetic conductive member 100*b*, the generated flux M2 generated in the antenna 70 passes the magnetic members 90*a* and 90*b* having lower magnetic resistances, and are repelled by the non-magnetic conductive members 100*a* and 100*b* so that the generated flux M2 hardly pass the watch case 60 and the back cover 62. Therefore, the eddy current loss originating from the magnetic flux passing through the metals of the watch case 60 and the back cover 62 hardly occurs, thereby suppressing the degradation (reduction) of the reception sensitivity of the antenna 70.

Sixth Embodiment

The sixth embodiment will be discussed below.

To avoid the redundant description, like or same reference numerals are given to those components of the sixth embodiment which are the same as the corresponding components of the fourth and fifth embodiments.

Structure of Wristwatch

Figure 22:
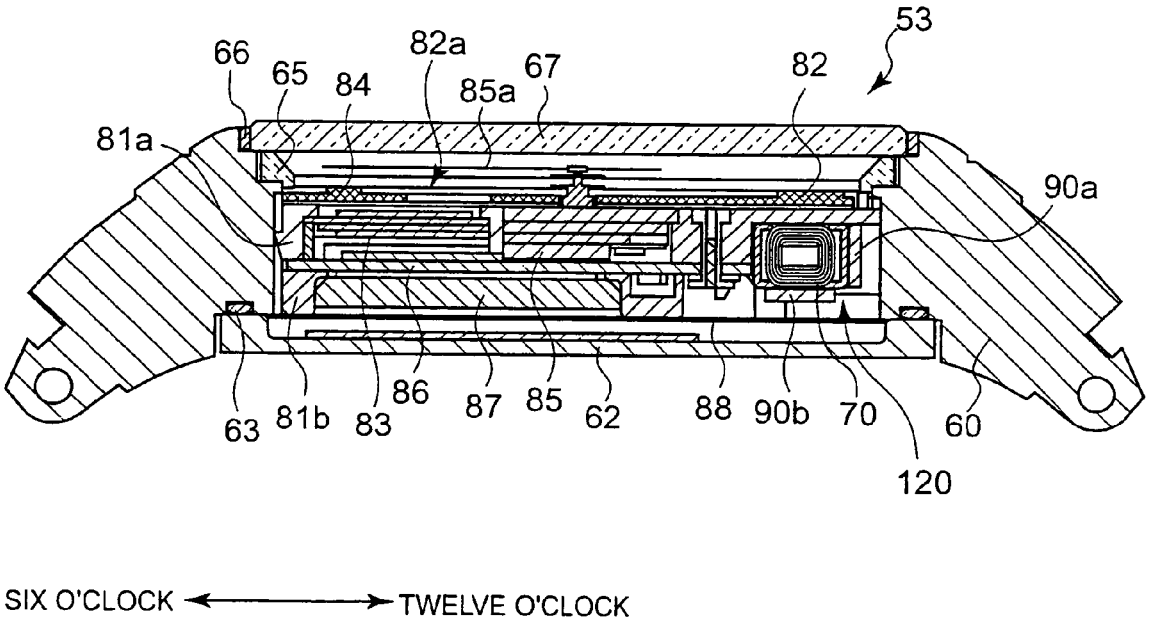
FIG. 22 is a cross-sectional view of a wristwatch according to a sixth embodiment of the invention along a 12-6 o'clock line.
Figure 23:
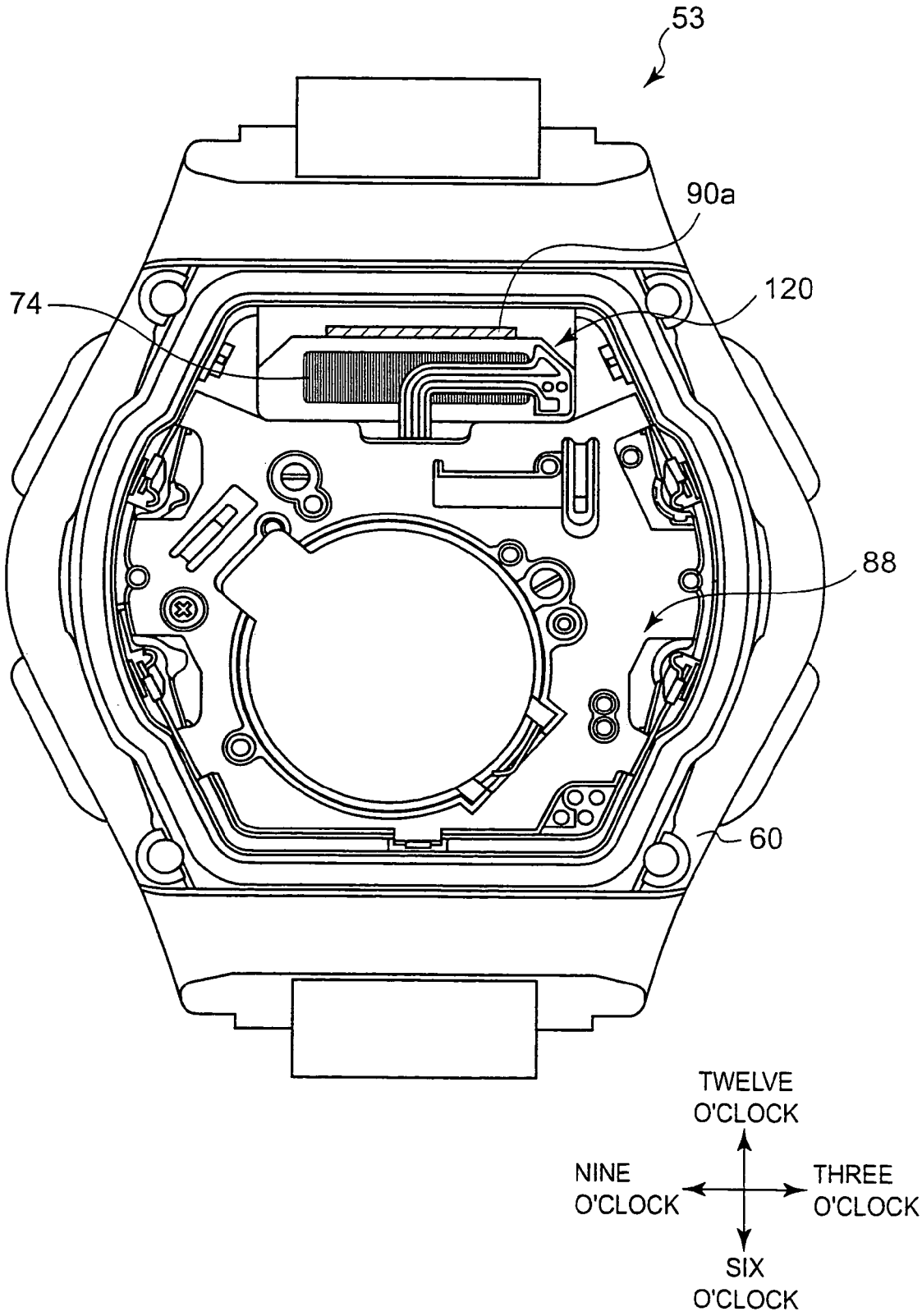
FIG. 23 is a back view of the wristwatch according to the sixth embodiment.

FIG. 22 is a cross-sectional view of a wristwatch 53 according to the sixth embodiment along the 12-6 o'clock line. FIG. 23 is a back view showing the essential portions of the wristwatch 53. FIG. 23 shows the back cover 62 and a part of the circuit presser 88 lying under the lower portion of the antenna 70 in a see-through fashion. As shown in FIGS. 22 and 23, a watch module, an antenna apparatus 120 supported on the upper housing 81*a* are disposed inside the watch case 60.

Figure 24A:
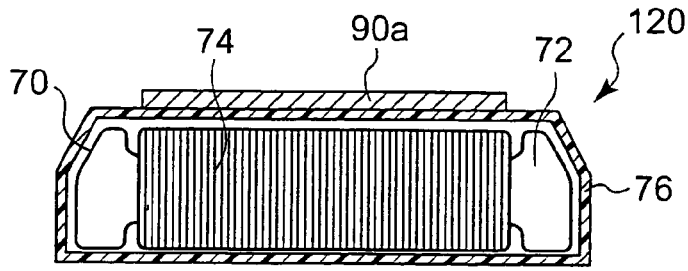
FIGS. 24A to 24C are diagrams showing the structure of an antenna apparatus.
Figure 24B:
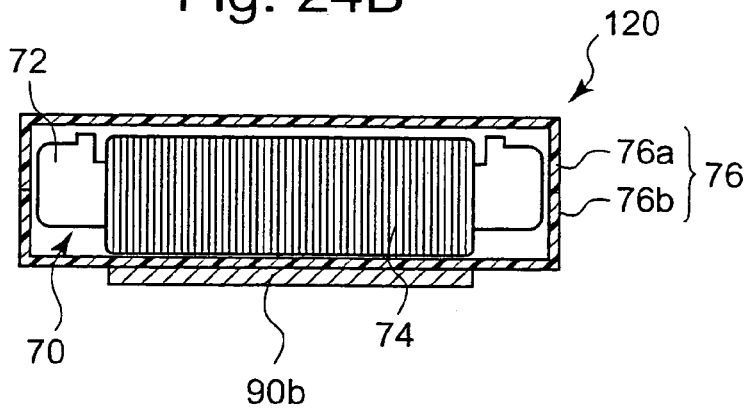
Figure 24C:
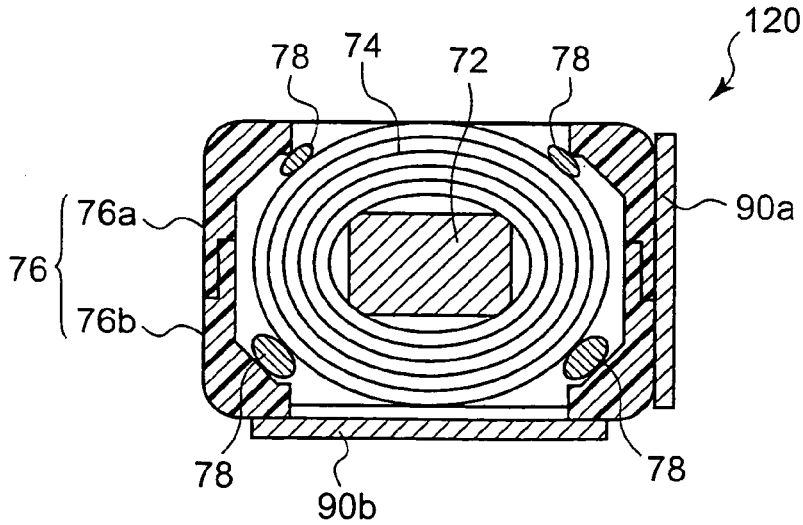

FIG. 24A is a plan view of the antenna apparatus 120, FIG. 24B is a front view of the antenna apparatus 120, and FIG. 24C is a vertical cross-sectional view of the antenna apparatus 120. For easier understanding of the layout of the antenna 70 in an antenna case 76, FIG. 24A shows the upper portion and FIG. 24B shows the front side portion both in a see-through fashion. As shown in FIGS. 24A, 24B and 24C, the antenna apparatus 120 has the antenna case 76, the antenna 70, an adhesive 78 to adhere the antenna case 76 to the antenna 70, a flexible board (not shown) which electrically connects the antenna 70 to the LSI board 86, and the magnetic members 90*a* and 90*b*.

The antenna case 76 is formed of, for example, a synthetic resin, such as polybutylene terephthalate (PBT), or paper, which does not shield electric waves, and has an upper piece 76*a* which surrounds the upper half of the antenna 70, and lower piece 76*b* which surrounds the lower half of the antenna 70. The upper piece 76*a* and the lower piece 76*b* each have an elongated box shape whose cross section has an inverted square C shape (] shape) with an open side, and hold the antenna 70 from the up and down directions in such a way that the open sides face each other, thereby retaining the antenna 70 inside.

The antenna case 76 is formed in such a way that the antenna 70, when housed inside the antenna case 76, abut on the inner surface of the antenna case 76, so that the antenna 70 is securely retained in the antenna case 76. As the antenna case 76 also serves to protect the antenna 70 against external shocks or so, it is formed to a certain thickness (specifically, 1.5 mm or so).

The adhesive 78 is, for example, an epoxy-based adhesive and is applied between the outer surface of the coil 74 and the inner surface of the antenna case 76 with the antenna 70 retained in the antenna case 76, so that point adhesion is made between the antenna 70 and the antenna case 76.

The magnetic members 90*a* and 90*b* are arranged in tight contact with the outer surface of the antenna case 76. Specifically, the magnetic member 90*a* is arranged at the outer side surface of the antenna case 76 facing the inner surface of the watch case 60 in such a way that the lengthwise direction becomes parallel to the axial direction of the core 72. That is, the magnetic member 90*a* is placed between the antenna 70 and the watch case 60. The magnetic member 90*b* is arranged at the outer bottom surface of the antenna case 76 facing the inner surface of the back cover 62 in such a way that the lengthwise direction becomes parallel to the axial direction of the core 72. That is, the magnetic member 90*b* is placed between the antenna 70 and the back cover 62.

As the magnetic members 90*a* and 90*b* are provided at the outer surface of the watch case 60, a clearance (gap) equivalent to at least the thickness of the watch case 60 is provided between the magnetic member 90*a*, 90*b* and the antenna 70. The lengthwise lengths of the magnetic members 90*a* and 90*b* are made equal to (or slightly shorter than) the length L of the coil 74, the magnetic members 90*a* and 90*b* do not face both end portions of the core 72 where the coil 74 is not wound.

Figure 25:
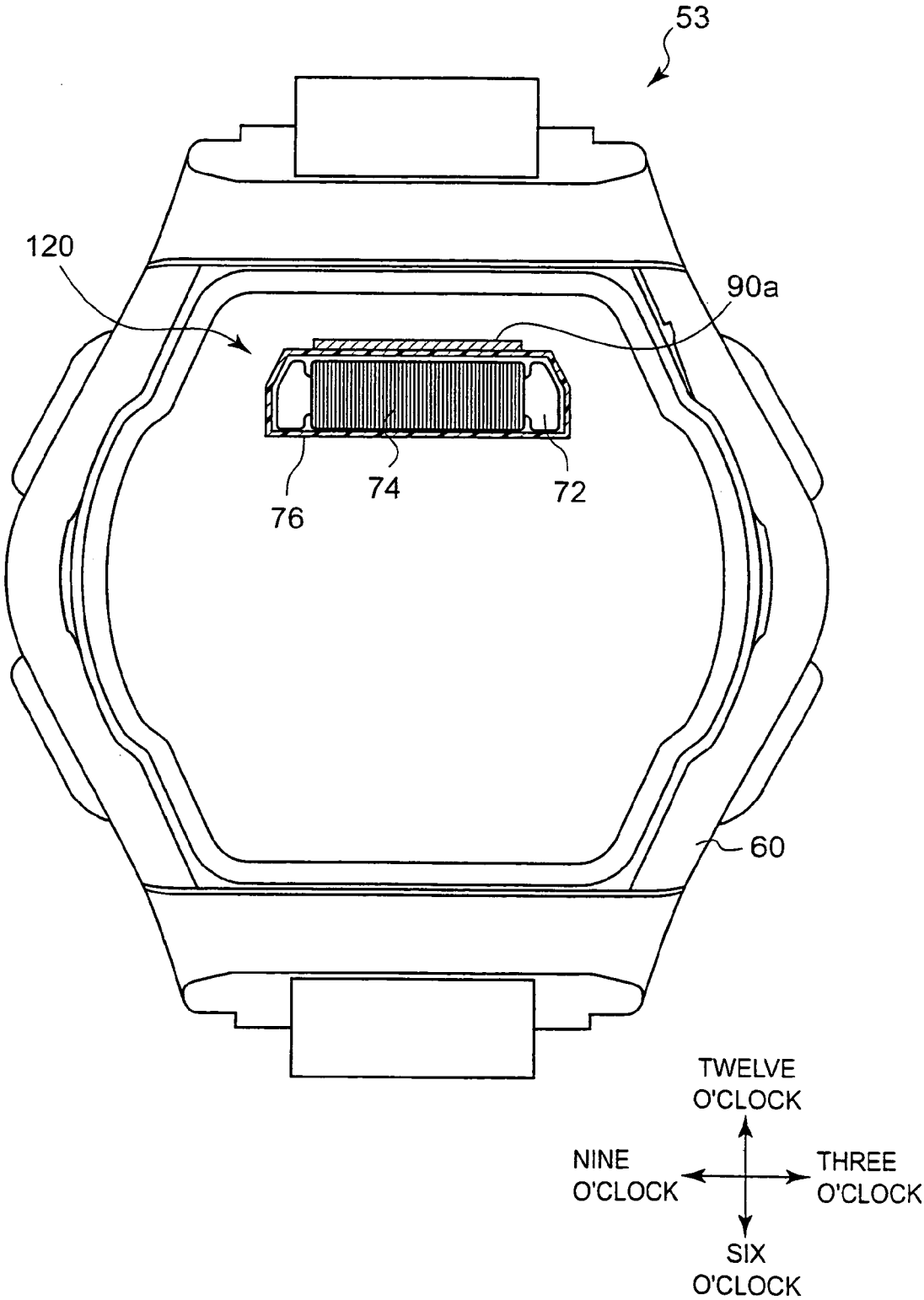
FIG. 25 is a schematic back view showing the layout of an antenna apparatus according to the sixth embodiment.

As shown in FIG. 25, the antenna apparatus 120 is arranged at a position close to the 12 o'clock position (the top side in FIG. 25) in the watch case 60. FIG. 25 is a back view showing the essential portions of the wristwatch 52, and shows only the antenna apparatus 120 in the watch case 60 for easier understanding of the layout of the antenna apparatus 120 inside the watch case 60. The antenna apparatus 120 is arranged in such a way that the axial line of the core 72 is in parallel to the 3-9 o'clock direction, the magnetic member 90*a* faces the inner surface of the watch case 60 and the magnetic member 90*b* faces the inner surface of the back cover 62.

Operation and Effect

According to the sixth embodiment, as discussed above, as the magnetic member 90*a* is arranged at the outer surface of the antenna case 76 at a position facing the inner surface of the watch case 60 made of a metal, and the magnetic member 90*b* is arranged at a position facing the top surface of the back cover 62 made of a metal, the generated flux M2 generated in the antenna 70 passes the magnetic members 90*a* and 90*b* having lower magnetic resistances, and hardly pass the watch case 60 and the back cover 62, as per the fourth embodiment. Therefore, the eddy current loss originating from the magnetic flux passing through the metals forming the watch case 60 and the back cover 62 hardly occurs, thereby suppressing the reduction of the reception sensitivity of the antenna 70.

Modifications of Fourth to Sixth Embodiments (a) Shapes of Magnetic Members 90*a* and 90*b* and Non-Magnetic Conductive Members 100*a* and 100*b*

Although the magnetic members 90*a* and 90*b* and the non-magnetic conductive members 100*a* and 100*b* are made into approximately rectangular thin plate shapes in each of the embodiments, the shapes are not restrictive, but other shapes may be taken. The magnetic members 90*a* and 90*b* and the non-magnetic conductive members 100*a* and 100*b* may be formed like films. In this case, however, the magnetic members 90*a* and 90*b* and the non-magnetic conductive members 100*a* and 100*b* should be arranged in such a way that the lengths of those portions of the magnetic members 90*a* and 90*b* and the non-magnetic conductive members 100*a* and 100*b* which face the antenna 70 (the lengths in the axial direction) are set nearly equal to (or slightly shorter than) the length L of the coil 74 and the magnetic members 90*a* and 90*b* and the non-magnetic conductive members 100*a* and 100*b* do not face both end portions of the core 72 where the coil 74 is not wound.

(B) Sizes of Magnetic Members 90*a* and 90*b*

Figure 26:
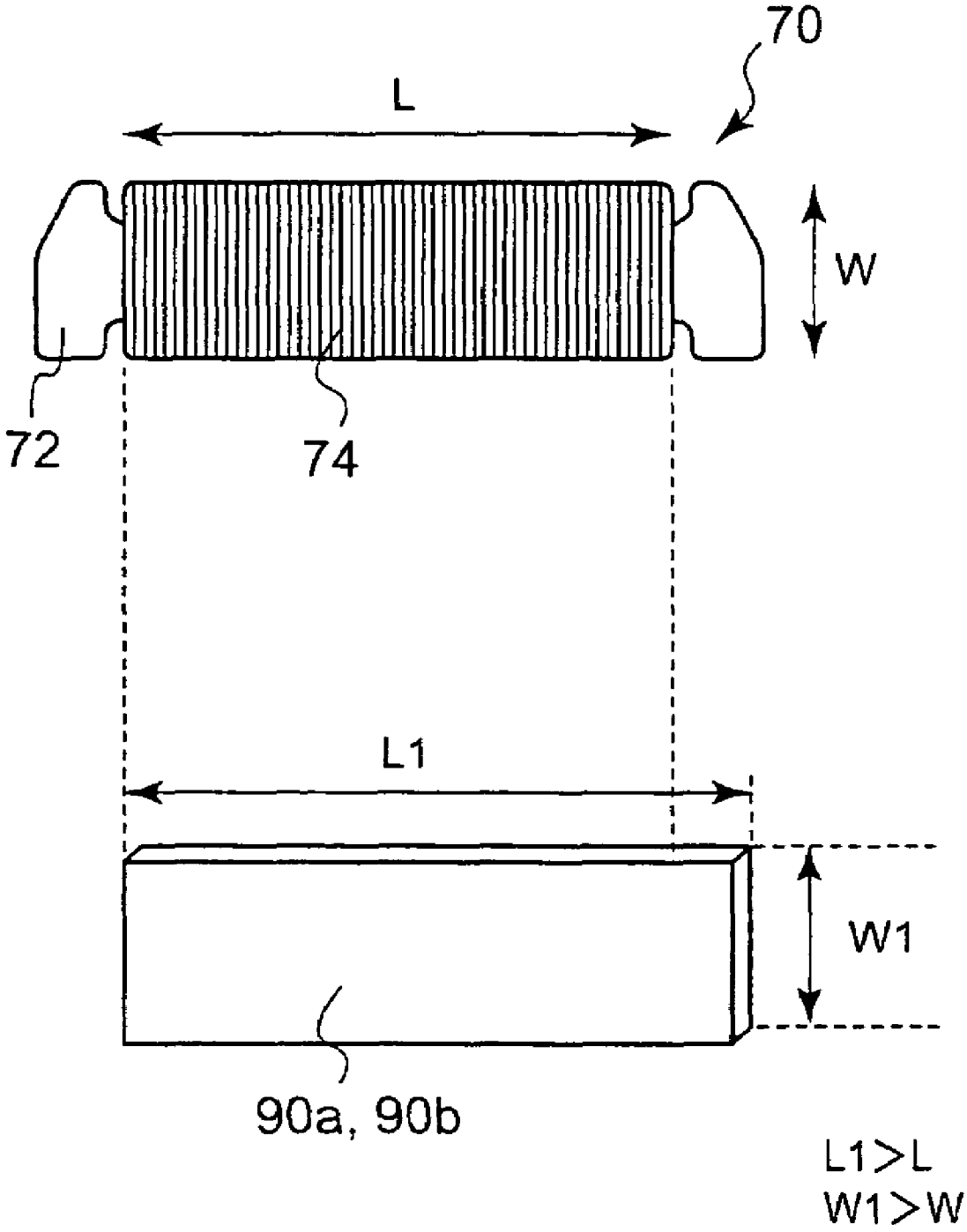
FIG. 26 is a diagram illustrating a modification of the structure of the magnetic member.

Although the lengthwise lengths of the magnetic members 90*a* and 90*b* are set equal to (or slightly shorter than) the length L of the coil 74 and the lengths in the direction of the short side are nearly equal to the width W of the coil 74 (see FIG. 11) in each embodiment discussed above, the sizes of the magnetic members 90*a* and 90*b* may be changed as shown in FIG. 26 in the fourth and fifth embodiments. That is, the lengthwise lengths of the magnetic members 90*a* and 90*b* may be set longer than the length L of the coil 74 and the length W1 in the direction of the short side may be set longer than the width W of the coil 74. It is to be noted that the lengths L1 and W1 are determined to be the values that improve the reception sensitivity of the antenna 70 as needed according to the structure of the wristwatch, such as the type of the magnetic material for the magnetic members 90*a* and 90*b* (specifically, the magnetic permeability μ) and the distances between the magnetic members 90*a* and 90*b* and the antenna 70.

(C) Sizes of Non-Magnetic Conductive Members 100*a* and 100*b*

Although the non-magnetic conductive members 100*a* and 100*b* and the magnetic members 90*a* and 90*b* are formed into approximately the same shapes in the fifth embodiment, the shape and size of the non-magnetic conductive member 100*a*, 100*b* may be made different from the shape and size of the magnetic member 90*a*, 90*b*. For example, the shape and size of the magnetic member 90*a*, 90*b* may be made smaller than those of the non-magnetic conductive member 100*a*, 100*b*. Alternatively, the shape and size of the magnetic member 90*a*, 90*b* may be made larger than those of the non-magnetic conductive member 100*a*, 100*b*.

(D) Antenna Apparatus 120

Figure 27A:
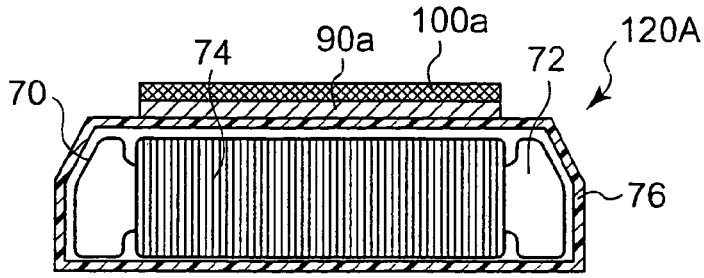
FIGS. 27A to 27C are diagrams illustrating a modification (1) of the antenna apparatus.
Figure 27B:
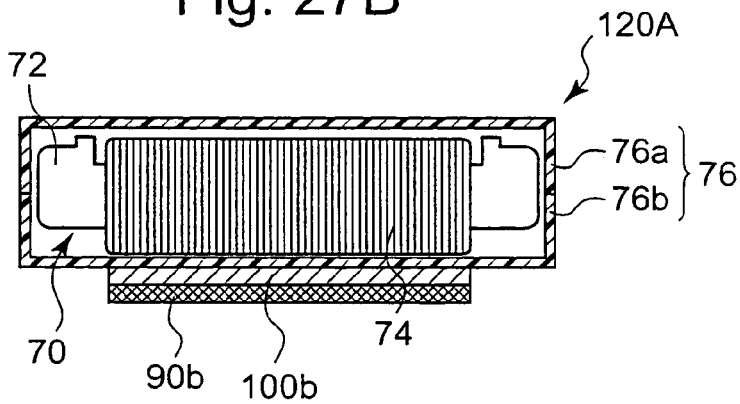
Figure 27C:
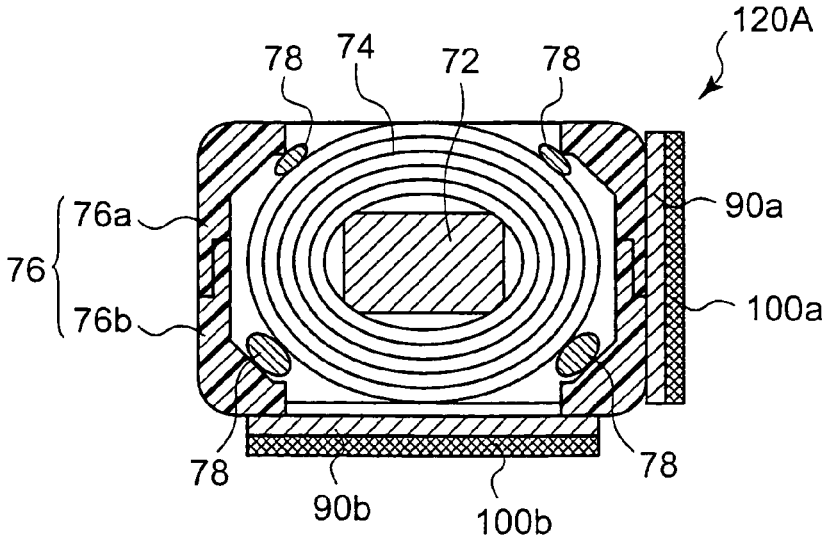
Figure 28:
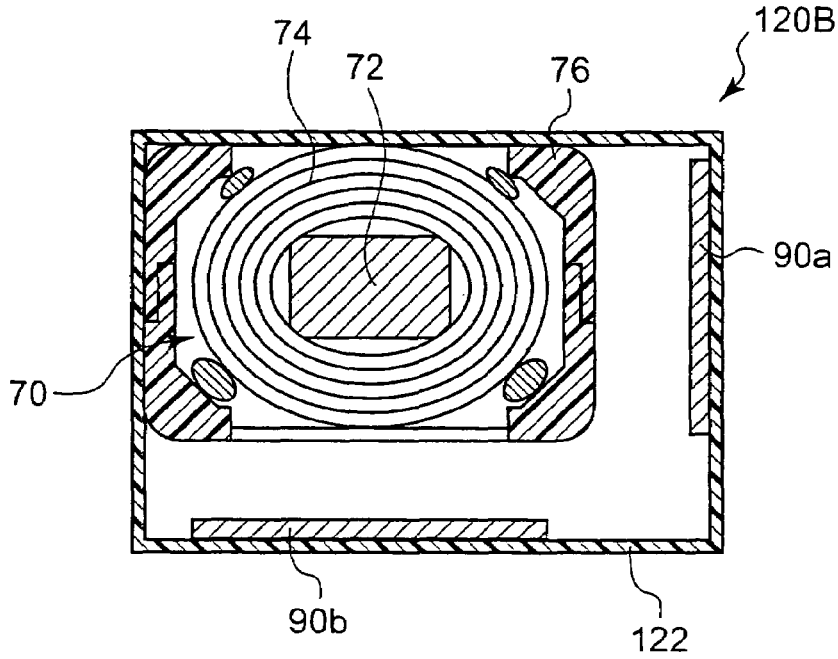
FIG. 28 is a diagram illustrating a modification (2) of the antenna apparatus.
Figure 29:
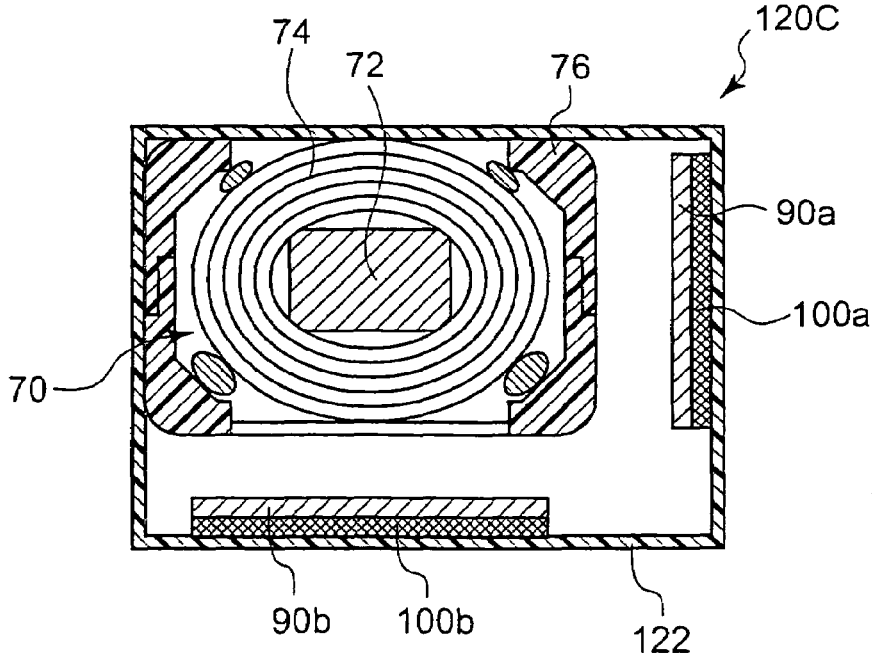
FIG. 29 is a diagram illustrating a modification (3) of the antenna apparatus.

The antenna apparatus 120 in the sixth embodiment may be so designed as to be an antenna apparatus 120A in FIGS. 27A, 27B and 27C, an antenna apparatus 120B in FIG. 28 or an antenna apparatus 120C in FIG. 29.

(D-1)

FIG. 27A is a plan view of the antenna apparatus 120A, FIG. 27B is a front view of the antenna apparatus 120A, and FIG. 27C is a vertical cross-sectional view of the antenna apparatus 120A. For easier understanding of the layout of the antenna 70 inside the antenna case 76, FIG. 27A shows the upper portion and FIG. 27B shows the front side portion both in a see-through fashion.

As shown in FIGS. 27A, 27B and 27C, the magnetic members 90*a* and 90*b* are arranged at the outer surface of the antenna case 76 in the antenna apparatus 120A. Specifically, the magnetic member 90*a* is so arranged as to face the coil 74 in such a way that it is in tight contact with the outer side surface of the antenna case 76 (the top side in FIG. 27A and the right-hand side in FIG. 27C) facing the inner surface of the watch case 60 (see FIG. 22), and the lengthwise direction is in parallel to the axial direction of the core 72. The non-magnetic conductive member 100*a* is arranged at and in tight contact with the top surface of the magnetic member 90*a*, overlying the magnetic member 90*a*. That is, the non-magnetic conductive member 100*a* is placed between the watch case 60 and the antenna 70.

The magnetic member 90*b* is so arranged as to face the coil 74 in such a way that it is in tight contact with the outer bottom surface of the antenna case 76 (the bottom side in FIG. 27B and the bottom side in FIG. 27C) facing the inner surface of the back cover 62 (see FIG. 22), and the lengthwise direction is in parallel to the axial direction of the core 72. The non-magnetic conductive member 100*b* is arranged at and in tight contact with the top surface of the magnetic member 90*b*, overlying the magnetic member 90*b*. That is, the non-magnetic conductive member 100*b* is placed between the back cover 62 and the antenna 70.

(D-2)

FIG. 28 is a vertical cross-sectional view of the antenna apparatus 120B. As shown in the diagram, the antenna apparatus 120B has a module case 122 in which the antenna case 76 retaining the antenna 70 inside and the magnetic members 90*a* and 90*b* are disposed.

The module case 122 is formed of, for example, a synthetic resin, such as polybutylene terephthalate (PBT), or paper, which does not shield electric waves, and has the shape of an approximately elongated parallelepiped with a square-shaped cross section.

In the diagram, the left side surface and the top side surface of the antenna case 76 are abutted against the inner surface of the module case 122 and are arranged closer to the left corner, with the lengthwise direction being in parallel to the lengthwise direction of the module case 122.

Referring to the diagram, the magnetic member 90*a* is arranged in such a way as to be in tight contact with the right inner surface of the module case 122 with the lengthwise direction being in parallel to the axial direction of the core 72 and face only the coil 74 but not to face both end portions of the core 72. In the diagram, the magnetic member 90*b* is arranged in such a way as to be in tight contact with the lower inner surface of the module case 122 with the lengthwise direction being in parallel to the axial direction of the core 72 and face only the coil 74 but not to face both end portions of the core 72.

The magnetic members 90*a* and 90*b* arranged at the inner surface of the module case 122 may be arranged at the outer side surface of the module case 122.

The antenna apparatus 120B is arranged at a position closer to 12 o'clock in the watch case 60 as the device case. Specifically, the antenna apparatus 120B is arranged in such a way that the axial direction of the core 72 of the antenna 70 is in parallel to the 3-9 o'clock direction, the magnetic member 90*a* faces the inner surface of the watch case 60, and the magnetic member 90*b* faces the inner surface of the back cover 62.

(D-3)

FIG. 29 is a vertical cross-sectional view of the antenna apparatus 120C. As shown in the diagram, the antenna apparatus 120C has the module case 122 in which the antenna case 76 retaining the antenna 70 inside, the magnetic members 90*a* and 90*b* and the non-magnetic conductive members 100*a* and 100*b* are disposed.

Referring to the diagram, the non-magnetic conductive member 100*a* is arranged in such a way as to be in tight contact with the right inner surface of the module case 122 with the lengthwise direction being in parallel to the axial direction of the core 72 and face only the coil 74 but not to face both end portions of the core 72. The magnetic member 90*a* is arranged in such a way as to be in tight contact with and overlying the top surface of the non-magnetic conductive member 100*a*.

Referring to the diagram, the non-magnetic conductive member 100*b* is arranged in such a way as to be in tight contact with the lower inner surface of the module case 122 with the lengthwise direction being in parallel to the axial direction of the core 72 and face only the coil 74 but not to face both end portions of the core 72. The magnetic member 90*b* is arranged in such a way as to be in tight contact with and overlying the top surface of the non-magnetic conductive member 100*b*.

The non-magnetic conductive members 100*a* and 100*b* arranged at the inner surface of the module case 122 may be arranged at the outer side surface of the module case 122.

The antenna apparatus 120C is arranged at a position closer to 12 o'clock in the watch case 60 as the device case. Specifically, the antenna apparatus 120C is arranged in such a way that the axial direction of the core 72 of the antenna 70 is in parallel to the 3-9 o'clock direction, the non-magnetic conductive member 100*a* faces the inner surface of the watch case 60, and the non-magnetic conductive member 100*b* faces the inner surface of the back cover 62.

Seventh Embodiment

Structure of Wristwatch

Figure 30:
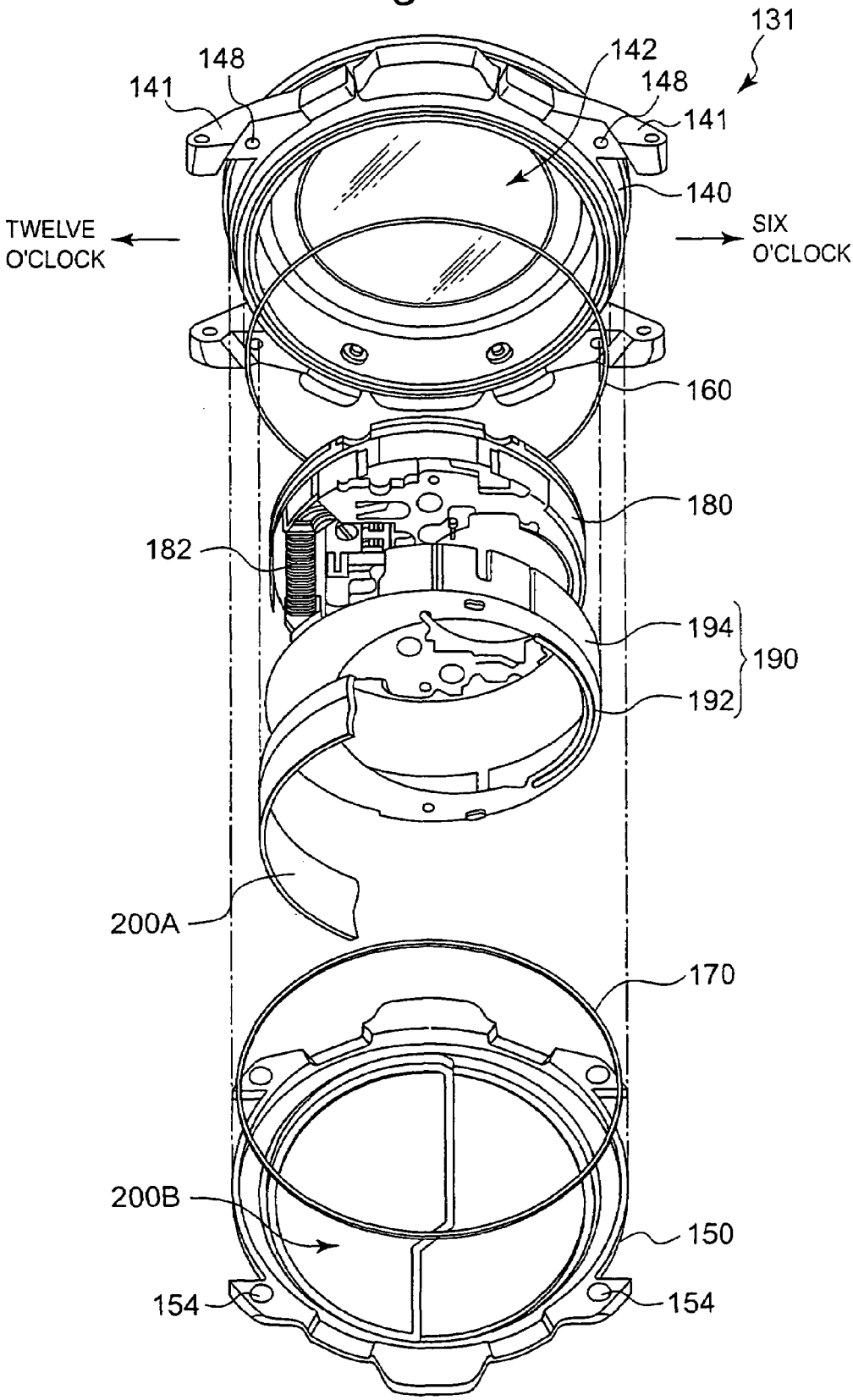
FIG. 30 is an exploded perspective view of a wristwatch according to a seventh embodiment of the invention.
Figure 31:
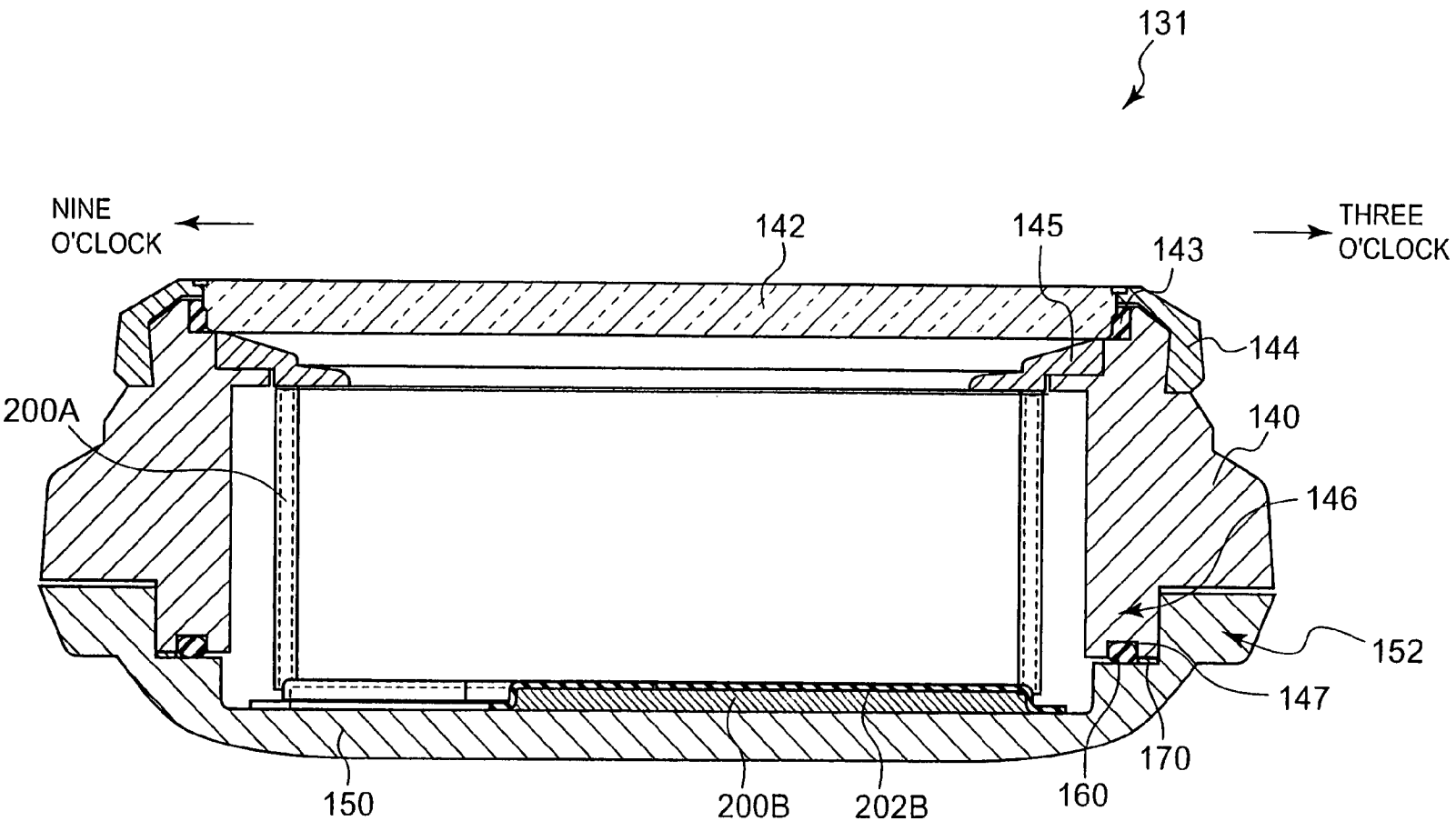
FIG. 31 is a schematic cross-sectional view of essential parts of the wristwatch in FIG. 30 (cross-sectional view along a 3-9 o'clock line)
Figure 32:
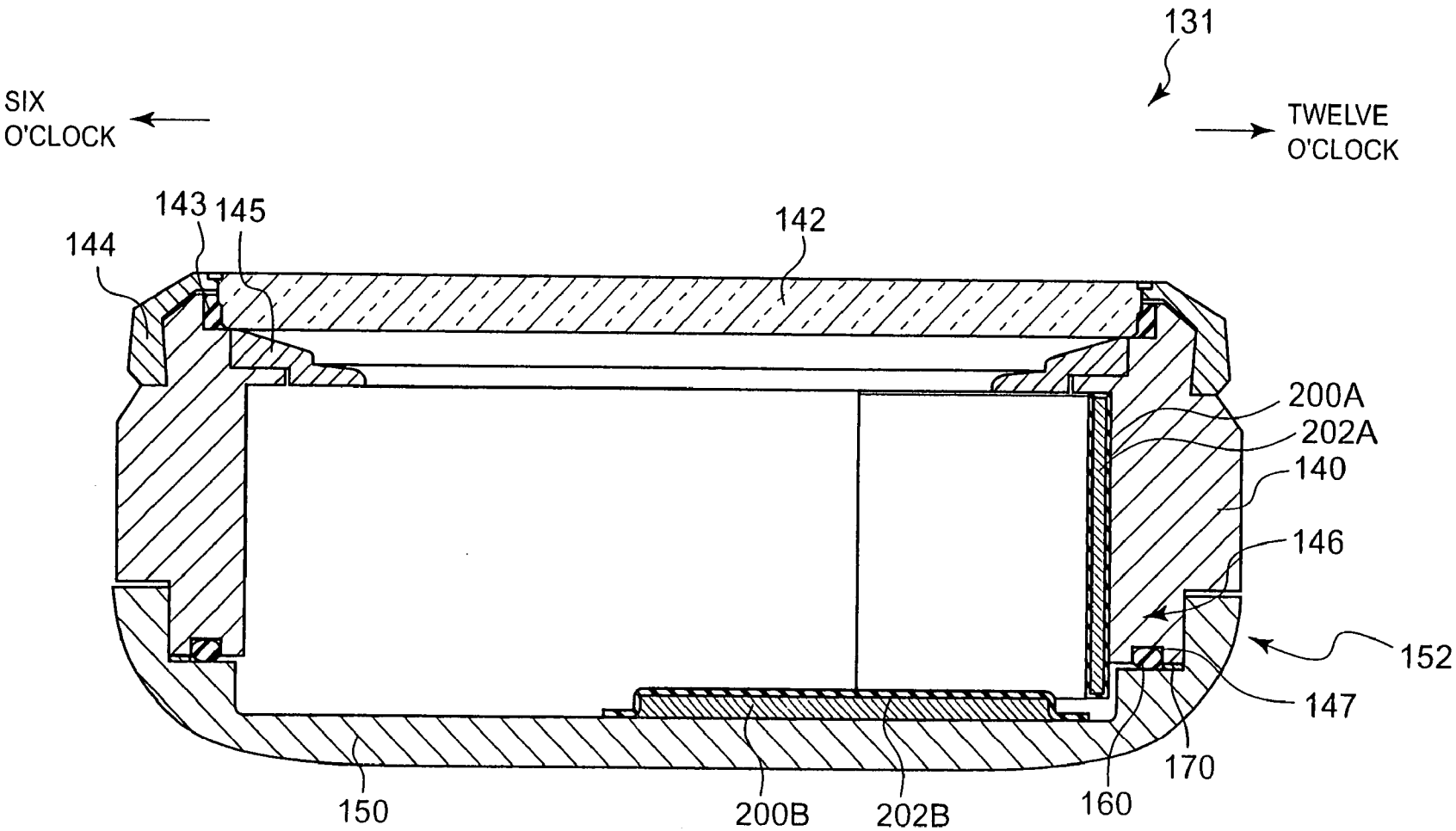
FIG. 32 is a schematic cross-sectional view of essential parts of the wristwatch in FIG. 30 (cross-sectional view along a 12-6 o'clock line)

FIG. 30 is an exploded perspective view of a wristwatch 131 according to the seventh embodiment. FIG. 31 is a cross-sectional view of the wristwatch 131 along the 3-9 o'clock line, and FIG. 32 is a cross-sectional view of the wristwatch 131 along the 12-6 o'clock line. For easier understanding of the essential structure of the embodiment, a watch module 180 and a frame member 190 are excluded from the illustration.

As shown in FIGS. 30 to 32, the wristwatch 131 has a watch case 140 in which the watch module 180 is to be retained, and a back cover 150 to be attached to the bottom side or back side of the watch case 140. The watch case 140 and the back cover 150 constitutes a device case as wristwatch case. The watch module 180 includes an antenna 182 for receiving the standard radio wave. That is, the wristwatch 131 is a radio wave watch which receives the standard radio wave and corrects the time.

The watch case 140 is formed of a strong metal, such as stainless steel or titanium, into a circular and annular shape with openings at the top and bottom surfaces, as seen from a planar view. Extending portions 141 extending outer sideways are formed at the 12 o'clock and 6 o'clock portions of the watch case 140, and band members (not shown) for attachment of the wristwatch 131 to the arm of a user are attached to the extending portions 141.

A watch glass 142 is fitted in the top center portion (viewing side) of the watch case 140 via a ring-shaped packing 143, and a bezel 144 for decorating the outer surface of the watch case 140 is attached to the top outer peripheral portion of the watch case 140. The bezel 144 is formed of a strong metal, such as stainless steel, into a thin frame shape. A panel cover 145 is arranged along the inner periphery of the watch case 140 inside the watch case 140 under the watch glass 142.

An annular projection 146 extending downward along the lower end portion of the watch case 140 is formed at the lower end portion of the watch case 140, and an annular ring groove 147 for layout of a water-proof ring 160 is formed in the annular projection 146. The water-proof ring 160 is formed of a resilient material, such as a synthetic resin or rubber, into a ring shape. When being placed in the annular ring groove 147, the water-proof ring 160 is pressed against the inner surface of the back cover 150. As the water-proof ring 160 is compressed between the watch case 140 and the back cover 150, the airtight state in the wristwatch case is secured.

The back cover 150 is formed of a strong metal, such as stainless steel or titanium, similar to the metal of the watch case 140, into an approximately flat and entirely thin shape. The back cover 150 has an annular rising portion 152 at the peripheral portion. The rising portion 152 is constructed in such a way that the projection 146 of the watch case 140 is positioned inside the rising portion 152, the inner surface abuts on the outer surface of the projection 146 of the watch case 140, and the outer surface is nearly flat forming no step at the outer surface of the watch case 140.

Insertion holes 154 respectively corresponding to four screw holes 148 formed in the bottom side of the watch case 140 are formed in the back cover 150. As screws (not shown) inserted into the respective insertion holes 154 from the back side of the back cover 150 are screwed into the respective screw holes 148, the back cover 150 is secured to the back side in such a way as to block the opening of the watch case 140.

Further, a stainless ring 170 which is a spacer member is placed between the watch case 140 and the back cover 150. The stainless ring 170 is formed of stainless steel into a thin ring shape, and is arranged outside the annular ring groove 147 along the inner surface of the rising portion 152 of the watch case 140. That is, the stainless ring 170 is held and fixed between the projection 146 of the watch case 140 and the back cover 150. As the stainless ring 170 is arranged inside the rising portion 152, it is not exposed outside the wristwatch 131.

The stainless ring 170 intervened between the watch case 140 and the back cover 150 produces a clearance equivalent to the thickness of the stainless ring 170 between the lower end portion of the watch case 140 and the back cover 150, and the watch case 140 and the back cover 150 contact only the outer side surface of the projection 146 of the watch case 140 and the inner surface of the rising portion 152. That is, the contact area between the watch case 140 and the back cover 150 becomes smaller. The contact resistance between the projection 146 of the watch case 140 and the stainless ring 170, and the contact resistance between the stainless ring 170 and the back cover 150 increase the electric resistance between the watch case 140 and the back cover 150 via the stainless ring 170. Because of the reasons, the electric resistance between the watch case 140 and the back cover 150 becomes higher than that in the case where the stainless ring 170 is not provided.

Without the stainless ring 170, the lower end portion of the watch case contacts the top surface of the back cover 150 over a wide range. When the demagnetization field generated in the antenna 182 passes the watch case 140 or the back cover 150, which is a metal member, in this state, as the current circulates in the entire watch case 140 and back cover 150 via the contact portions, the reception sensitivity of the antenna 182 degrades (decreases). The arrangement of the stainless ring 170 as in the embodiment however increases the electric resistance between the watch case 140 and the back cover 150, suppressing the current circulating in the watch case 140 and the back cover 150. This improves the reception sensitivity of the antenna 182.

The watch module 180 is supported on the frame member 190 and disposed (retained) in the watch case 140. The watch module 180 includes the antenna 182 that receives the standard radio wave, an IC chip having various circuits, and an analog hand mechanism which moves hands, such as an hour hand and a second hand, on the face.

The antenna 182 is a bar antenna which has a rod-like core formed of a magnetic material with a high specific magnetic permeability and a low electric conductivity, such as amorphous magnetic or ferrite, and a coil formed by winding a conductive wire of copper or so around the core. When the antenna 182 is placed in a magnetic field generated by the standard radio wave, the magnetic flux produced by the magnetic field is concentrated on the core whose magnetic permeability is higher than the magnetic permeability of the surrounding space, and crosses the coil in a chain fashion. As a result, induced electromotive force is generated in the coil in such a way as to generate a demagnetization field (flux) in the direction of interfering a change in magnetic flux in the coil.

The circuit elements that are mounted on the IC chip include a control IC, such as a CPU, which controls the individual sections of the watch module, a reception circuit which is electrically connected to the coil of the antenna 182 by a lead wire of copper or so to detect the induced electromotive force, generated in the coil, amplify and demodulate the detected electric signal, and acquire time data (i.e., time code) included in the standard radio wave, and a timing circuit having an oscillator to measure the current time. The control IC performs processes, such as correcting the time measured by the timing circuit based on the time data acquired by the reception circuit, and controlling the analog hand mechanism to move the hands to indicate the corrected current time.

The frame member 190 has a thin circular bottom portion 192 and a side portion 194 running along the peripheral portion of the bottom portion 192, supports the watch module 180 from below and serves as a cushion for the other components to protect the watch module 180. That portion of the side portion 194 which faces the antenna 182 included in the watch module 180 (about ⅓ portion closer to 12 o'clock in FIG. 30) is cut away, and a magnetic sheet 200A with a shape and a thickness equivalent to the size of the cutaway is arranged at the cutaway portion and covered with an insulating sheet 202A to serve as a part of the side portion 194.

Figure 33:
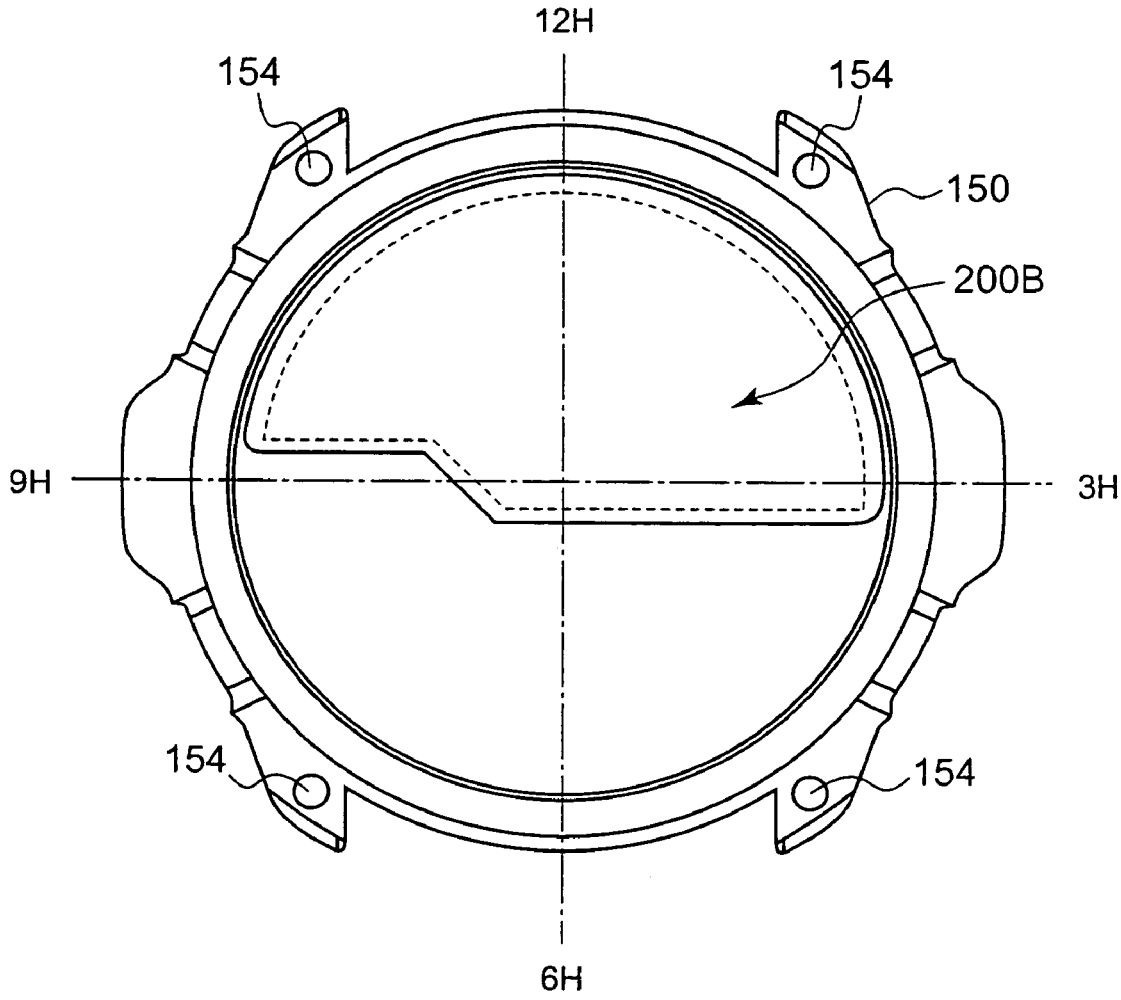
FIG. 33 is a front view of a back cover of the wristwatch in FIG. 30.

As shown in FIG. 33, a magnetic sheet 200B is provided at that portion of the top surface of the back cover 150 which faces the antenna 182 (about ½ portion closer to 12 o'clock in the diagram), and is covered with an insulating tape 202B in tight contact with the top surface of the back cover 150, as shown in FIGS. 31 and 32. FIG. 33 is a front view of the back cover 150.

Each of the magnetic sheets 200A and 200B is a sheet formed by dispersing and mixing magnetic powder of amorphous magnetic or ferrite or metal powder of copper or aluminum into a resin into, for example, a sheet. The magnetic member has a magnetic permeability higher than those of the watch case 140 and the back cover 150 and has a electric conductivity lower than those of the watch case 140 and the back cover 150. That is, the magnetic sheets 200A and 200B or magnetic members are respectively disposed between the watch case 140 and the back cover 150, both of which are metal members, and the antenna 182.

The magnetic sheets 200A and 200B also suppress degrading (reduction) of the reception efficiency of the antenna 182. The magnetic sheet which is a magnetic member has an effect of blocking an external magnetic field. Therefore, the demagnetization field (flux) that is generated in the antenna 182 by the standard radio wave is blocked by the magnetic sheets 200A and 200B, and hardly passes the watch case 140 and the back cover 150. Accordingly, the eddy current originating from the magnetic field passing a metal is hardly produced in the watch case 140 and the back cover 150, which are metal members, thereby suppressing degrading (reduction) of the reception efficiency of the antenna 182 originating from the nearby metal.

Measuring Results

FIGS. 34A and 34B are diagrams showing results of measuring the reception sensitivity of the antenna 182 with the stainless ring 170 and without the stainless ring 170. FIG. 34A shows the measurements when the stainless ring 170 is not present, and FIG. 34B shows the measurements when the stainless ring 170 is present (i.e., the wristwatch 131 of the embodiment). FIGS. 34A and 34B differ from each other in the presence or absence of the stainless ring 170, with all the other measuring elements being identical.

In the measurement, an electric wave containing a time code was sent from a transmitter at a remote position by a predetermined distance and the minimum output field intensity of the transmitter capable of receiving the time code was measured as the reception sensitivity at individual wristwatches that are provided/not provided with the stainless ring 170. The transmitter sent standard radio waves of 40 kHz (JJY40) and 60 kHz (JJY60) that are the current operational frequencies. Here, "capable of receiving" means that the time code can be extracted from the received electric wave.

As apparent from FIGS. 34A and 34B, in either one of the cases of the frequency of 40 kHz and the frequency of 60 kHz, the minimum output field intensity is lower (smaller) with the stainless ring 170 shown in FIG. 34B than without the stainless ring 170 shown in FIG. 34A. That is, it is apparent that the provision of the stainless ring 170 improves the reception sensitivity of the antenna 182. Specifically, the reception sensitivity was improved by 2 to 3 dBμ V/m in this example.

Operation and Effect

According to the seventh embodiment, in the wristwatch retaining the antenna 182 in the metal watch case 140, the stainless ring 170 intervened between the watch case 140 and the back cover 150 increases the electric resistance between the watch case 140 and the back cover 150, thereby improving the reception sensitivity of the antenna 182.

Modifications of Seventh Embodiment

The seventh embodiment may be modified in the following manners.

(1) The stainless ring 170 is formed of a metal other than stainless steel.

(2) The stainless ring 170 is formed of a non-conductive material, such as a resin or ceramic. In this case, the watch case 140 is insulated from the back cover 150. That is, the watch case 140 and the back cover 150 become non-conductive, so that the current circulating in the watch case 140 and the back cover 150 is mostly prevented. As a result, the degrading of the reception sensitivity of the antenna 182 is suppressed.

Although the foregoing description of the first to seventh embodiments has been given of the case where the present invention is adapted to a wristwatch which is one kind of an electronic device, the invention is also adaptable to electronic devices each having an antenna disposed in the device case, including other types of radio wave watches, such as a pocket watch and a travel watch, besides a wristwatch, and a portable telephone, and a radio.

Various embodiments and changes may be made there unto without departing from the broad spirit and scope of the invention. The above-described embodiments are intended to illustrate the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2003-402675 filed on Dec. 2, 2003 and No. 2004-125922 filed on Apr. 21, 2004 and including specification, claims, drawings and summary. The disclosure of the above Japanese patent applications is incorporated herein by reference in their entirety.

What is claimed is:

1. A radio-controlled wristwatch comprising:

a metal case;

an antenna disposed inside said case; and a magnetic member which is placed between an inner surface of said case and said antenna, and which has a magnetic permeability that is higher than a magnetic permeability of said case and an electric conductivity that is lower than an electric conductivity of said case; and a flux resilience member which is disposed between said case and said magnetic member and which has an electric conductivity that is higher than the electric conductivity of said case and a magnetic permeability that is higher than 1 and lower than said magnetic permeability of said magnetic member;

wherein a demagnetization flux, which is generated in said antenna when said antenna is placed in a magnetic field of a standard radio wave, passes through the magnetic member.

2. The radio-controlled wristwatch according to claim 1, wherein said magnetic member is provided at said inner surface of said case.

3. The radio-controlled wristwatch according to claim 1, wherein a watch module is housed in said case, and said antenna and other electronic parts are retained in said watch module, and wherein said magnetic member is provided between said inner surface of said case and an outer surface of said watch module.

4. The radio-controlled wristwatch according to claim 1, wherein said magnetic member comprises a magnetic sheet having a magnetic material dispersed in a resin sheet.

5. The radio-controlled wristwatch according to claim 1, wherein said antenna comprises a rod-shaped core and a coil wound around said core, and said magnetic member comprises a plate-like or film-like member arranged in parallel to an axial direction of said core.

6. The radio-controlled wristwatch according to claim 1, wherein a watch module is housed in said case, and said antenna and other electronic parts are retained in said watch module, wherein a frame member which includes a cutaway facing said antenna is positioned between said inner surface of said case and said watch module, and wherein said magnetic member is provided at said cutaway of said frame member.

7. The radio-controlled wristwatch according to claim 1, further comprising:

a metal back cover to be attached to a bottom side of said case; and a ring-shaped spacer member, which is intervened between said case and said back cover, and which increases an electric resistance between said case and said back cover.

8. The radio-controlled wristwatch according to claim 1, further comprising:

a metal back cover to be attached to a bottom side of said case; and a ring-shaped spacer member, which is intervened between said case and said back cover, and which insulates said case and said back cover from each other.

9. The radio-controlled wristwatch according to claim 1, further comprising:

a metal back cover to be attached to a bottom side of said case; and a magnetic member which is placed between an inner surface of said back cover and said antenna, and which has a magnetic permeability that is higher than a magnetic permeability of said back cover and an electric conductivity that is lower than an electric conductivity of said back cover.

10. The radio-controlled wristwatch according to claim 1, wherein said flux resilience member is arranged at said inner surface of said case, and said magnetic member is arranged on said flux resilience member.

11. A radio-controlled wristwatch comprising:

a case;

a metal back cover to be attached to a bottom side of said case;

an antenna disposed inside said case;

a magnetic member which is placed between an inner surface of said back cover and said antenna, and which has a magnetic permeability that is higher than a magnetic permeability of said back cover and an electric conductivity that is lower than an electric conductivity of said back cover; and a flux resilience member which is disposed between said back cover and said magnetic member and which has an electric conductivity that is higher than the electric conductivity of said back cover and a magnetic permeability that is higher than 1 and lower than said magnetic permeability of said magnetic member;

wherein a demagnetization flux, which is generated in said antenna when said antenna is placed in a magnetic field of a standard radio wave, passes through the magnetic member.

12. The radio-controlled wristwatch according to claim 11, wherein said magnetic member is provided at said inner surface of said back cover.

13. The radio-controlled wristwatch according to claim 11, wherein a watch module is housed in said case, and said antenna and other electronic parts are retained in said watch module, and wherein said magnetic member is provided at an outer surface of said watch module.

14. The radio-controlled wristwatch according to claim 11, wherein said magnetic member comprises a magnetic sheet having a magnetic material dispersed in a resin sheet.

15. The radio-controlled wristwatch according to claim 11, wherein said case is made of metal, and further comprising:

a ring-shaped spacer member, which is intervened between said case and said back cover, and which increases an electric resistance between said case and said back cover.

16. The radio-controlled wristwatch according to claim 11, wherein said case is made of metal, and further comprising:

a ring-shaped spacer member, which is intervened between said case and said back cover, and which insulates said case and said back cover from each other.

17. The radio-controlled wristwatch according to claim 11, wherein said flux resilience member is arranged at said inner surface of said back cover, and said magnetic member is arranged on said flux resilience member.

18. A radio-controlled wristwatch, comprising:

a metal case;

an antenna;

a watch module in which said antenna and parts of the watch are retained, and which is disposed inside said case;

a magnetic member which is placed between an outer circumference surface of said watch module and an inner circumference surface of said case, and which has a magnetic permeability that is higher than a magnetic permeability of said case and an electric conductivity that is lower than an electric conductivity of said case; and a flux resilience member which is disposed between said case and said magnetic member and which has an electric conductivity that is higher than the electric conductivity of said case and a magnetic permeability that is higher than 1 and lower than said magnetic permeability of said magnetic member;

wherein a demagnetization flux which is generated in said antenna when said antenna is placed in a magnetic field of a standard radio wave, passes through the magnetic member.

19. The radio-controlled wristwatch according to claim 18, wherein said magnetic member is provided at said inner circumference surface of said case.

20. The radio-controlled wristwatch according to claim 18, wherein said magnetic member is provided at said outer circumference surface of said watch module.

21. The radio-controlled wristwatch according to claim 18, wherein said magnetic member comprises a magnetic sheet having a magnetic material dispersed in a resin sheet.

22. The radio-controlled wristwatch according to claim 18, wherein a frame member which includes a cutaway facing said antenna is positioned between said inner circumference surface of said case and said outer circumference surface of said watch module, and wherein said magnetic member is provided at said cutaway of said frame member.

23. The radio-controlled wristwatch according to claim 18, wherein said flux resilience member is arranged at said inner circumference surface of said case, and said magnetic member is arranged on said flux resilience member.

* * * * *